US008365332B2

(12) United States Patent
Allen et al.

(10) Patent No.: US 8,365,332 B2
(45) Date of Patent: Feb. 5, 2013

(54) UTILITY BAR

(75) Inventors: Joel Allen, Winton, CA (US); Mark R. Martinez, Atwater, CA (US); Timothy Albrecht, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 460 days.

(21) Appl. No.: 12/614,071

(22) Filed: Nov. 6, 2009

(65) Prior Publication Data

US 2010/0115705 A1 May 13, 2010

Related U.S. Application Data

(60) Provisional application No. 61/112,489, filed on Nov. 7, 2008.

(51) Int. Cl.
*B66F 15/00* (2006.01)
*B67B 7/00* (2006.01)
*B25C 11/00* (2006.01)

(52) U.S. Cl. ..... 7/166; 7/151; 254/25; 254/18; 254/21

(58) Field of Classification Search ..... 7/151, 166; 254/25, 18, 131, 21, 131.5, 120, 130
See application file for complete search history.

(56) References Cited

U.S. PATENT DOCUMENTS

| | | | | |
|---|---|---|---|---|
| 2,863,635 | A * | 12/1958 | Fandrich | 254/25 |
| D226,057 | S | 1/1973 | Grindlinger | |
| 4,745,651 | A | 5/1988 | Schellenger | |
| 4,831,901 | A | 5/1989 | Kinne | |
| 4,944,203 | A | 7/1990 | Miller | |
| D324,474 | S | 3/1992 | Killins | |
| 5,315,724 | A | 5/1994 | Trujillo et al. | |
| 5,526,719 | A | 6/1996 | Chen | |
| 5,695,172 | A * | 12/1997 | Hreha | 254/25 |
| D390,082 | S | 2/1998 | Higgs | |
| 5,749,113 | A | 5/1998 | Witter | |
| 5,957,429 | A | 9/1999 | Khachatoorian | |
| 5,979,058 | A | 11/1999 | Henke | |
| 6,016,722 | A | 1/2000 | Gierer et al. | |
| D440,854 | S | 4/2001 | Killins | |
| D442,456 | S | 5/2001 | Killins | |
| 6,257,553 | B1 | 7/2001 | Khachatoorian | |
| 6,397,420 | B1 | 6/2002 | Roxton | |
| 6,421,860 | B1 | 7/2002 | Abbott | |
| 6,427,274 | B1 | 8/2002 | Abbott | |
| 6,497,399 | B1 | 12/2002 | Nelson | |
| 6,536,308 | B1 | 3/2003 | Thorne et al. | |
| 6,604,728 | B1 | 8/2003 | Boydon | |
| 6,604,729 | B2 | 8/2003 | Fagan | |
| 6,629,684 | B2 | 10/2003 | Youngren et al. | |
| 6,655,236 | B1 | 12/2003 | Slack et al. | |
| 6,678,909 | B1 | 1/2004 | Pyatt | |
| D507,167 | S | 7/2005 | Richardson | |

(Continued)

*Primary Examiner* — Bryan R Muller
(74) *Attorney, Agent, or Firm* — Michael Best & Friedrich LLP

(57) ABSTRACT

A utility bar includes a shank portion for providing a grip, the shank portion including a first end and a second end, a substantially arch-shaped head portion extending from the first end of the shank portion, and a pry bar portion extending from the second end of the shank portion. Each of the head portion and the pry bar portion define a free end of the utility bar. The utility bar also includes a first facet including the free end of the head portion, a second facet extending from the first facet at an angle with respect to the first facet and positioned between the free end of the head portion and the shank portion, and a first fulcrum edge between the first and second facets for providing a first pivot point about which the utility bar is pivoted to provide leverage.

26 Claims, 18 Drawing Sheets

U.S. PATENT DOCUMENTS

| | | | | |
|---|---|---|---|---|
| 6,913,246 | B1 | 7/2005 | Skach | |
| 6,923,432 | B1 | 8/2005 | Martinez | |
| 6,988,711 | B2 | 1/2006 | Skach | |
| 7,051,390 | B2 | 5/2006 | van Beek | |
| D525,506 | S | 7/2006 | Downing, Jr. | |
| 7,096,761 | B2 | 8/2006 | Schoor | |
| 7,334,502 | B1 | 2/2008 | Durkee | |
| 7,350,440 | B2 | 4/2008 | Casolco | |
| 7,438,279 | B2 * | 10/2008 | Eby et al. | 254/25 |
| 7,503,545 | B2 | 3/2009 | Verbowski | |
| 2002/0092386 | A1 | 7/2002 | Lin | |
| 2004/0261188 | A1 | 12/2004 | Mathis | |
| 2005/0062026 | A1 | 3/2005 | Holcomb | |
| 2005/0172415 | A1 | 8/2005 | Beek | |
| 2005/0229322 | A1 | 10/2005 | Chiu et al. | |
| 2006/0026800 | A1 | 2/2006 | Lawless | |
| 2006/0075572 | A1 | 4/2006 | Young | |
| 2007/0119279 | A1 | 5/2007 | Fisher et al. | |
| 2007/0226913 | A1 | 10/2007 | Woolley et al. | |
| 2008/0178393 | A1 | 7/2008 | Kinskey et al. | |
| 2008/0251773 | A1 | 10/2008 | Smeeton et al. | |
| 2009/0000039 | A1 | 1/2009 | St. John et al. | |
| 2009/0230369 | A1 * | 9/2009 | Kurtz | 254/131 |

* cited by examiner

UTILITY BAR

CROSS-REFERENCE TO RELATED APPLICATION

This application claims priority to co-pending U.S. Provisional Patent Application Ser. No. 61/112,489 filed on Nov. 7, 2008, the entire contents of which are incorporated herein by reference.

BACKGROUND

The present invention relates to a utility bar, and in particular a multi-use tool bar.

Generally, utility bars are useful for removing fasteners, such as nails, and prying work pieces. Utility bars include nail removers at free ends and curved rocking surfaces for providing leverage for the removal of fasteners.

SUMMARY

In one aspect, the invention provides a utility bar including a shank portion for providing a grip, the shank portion including a first end and a second end, a substantially arch-shaped head portion extending from the first end of the shank portion, and a pry bar portion extending from the second end of the shank portion. Each of the head portion and the pry bar portion define a free end of the utility bar. The utility bar also includes a first facet including the free end of the head portion, a second facet extending from the first facet at an angle with respect to the first facet and positioned between the free end of the head portion and the shank portion, and a first fulcrum edge between the first and second facets for providing a first pivot point about which the utility bar is pivoted to provide leverage.

In another aspect, the invention provides a utility bar including a shank portion including a grip and defining a plane through the shank portion that is parallel to a top or bottom surface of the shank portion. The plane has a first side and a second side opposite the first side. The utility bar also includes a substantially arch-shaped head portion extending from a first end of the shank portion, the head portion having a first section extending from the shank portion and positioned on the first side of the plane and a second section extending from the first section and positioned on the second side of the plane. A pry bar portion extends from a second end of the shank portion. An opening is formed in the first section of the head portion, the opening configured for pulling fasteners.

Other aspects of the invention will become apparent by consideration of the detailed description and accompanying drawings.

Figure 1A:
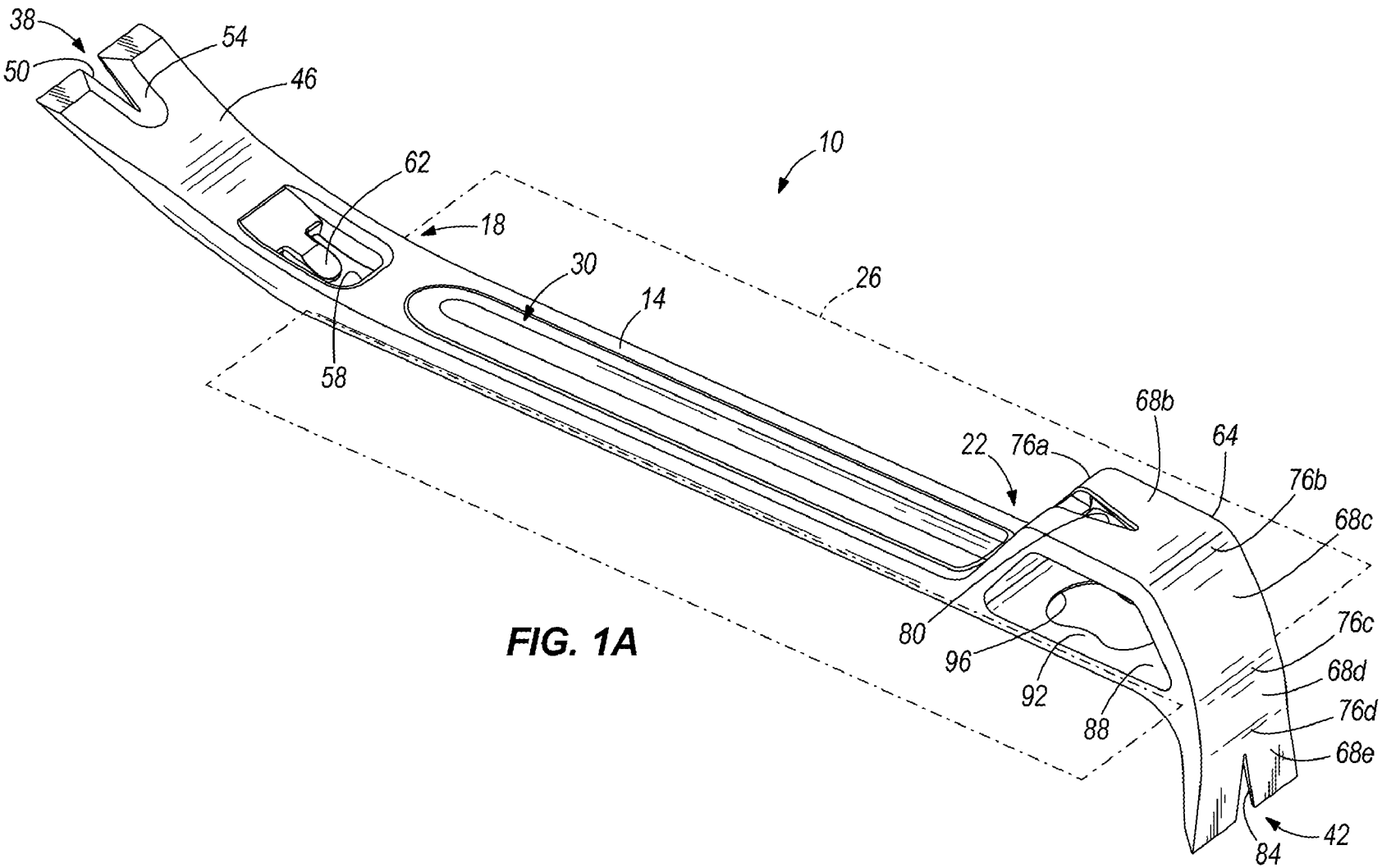
FIG. 1A is a perspective view of a utility bar according to one construction of the invention.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limiting.

DETAILED DESCRIPTION

FIGS. 1A-6F illustrate a number of constructions of a multi-use utility bar. In some or all constructions, the utility bar is a titanium or a titanium alloy utility bar formed as a single piece. The use of titanium reduces the transmission of vibrations and reduces the recoil of a striking tool when the utility bar is struck. In other constructions, the utility bar may be formed of steel or other suitable materials.

FIGS. 1A-1F illustrate a utility bar 10 according to one construction of the invention. The utility bar 10 includes a substantially straight shank 14 having a first end 18, a second end 22, and the shank 14 defining a plane 26 and a longitudinal axis 28. The shank 14 provides a grip for a user of the utility bar 10. A pry bar portion 46 extends from the first end

18 of the shank 14, and a head portion 64 extends from the second end 22 of the shank 14. The utility bar 10 has a top surface 30 and a bottom surface 34. The plane 26 passes through the shank 14 and is parallel to the top surface 30 and the bottom surface 34 of the shank 14. Referring to FIG. 1B, the utility bar 10 has an overall length L1 measured between a first free end 38 located on the pry bar portion 46 and a second free end 42 located on the head portion 64. In the illustrated construction, the length L1 is approximately 15 inches. In other constructions, the utility bar 10 may have an overall length greater than or less than 15 inches. The shank 14 of the utility bar 10 also has a width W1, as shown in FIG. 1B, which is approximately 1.5 inches. In other constructions, the width W1 may be less than or greater than 1.5 inches.

The pry bar portion 46 extends from the first end 18 of the straight shank 14 and includes a notch 50 at the first free end 38. The notch 50 is generally V-shaped and assists with the removal of fasteners from a workpiece. The pry bar portion 46 also includes a beveled surface 54 that extends between the top surface 30 and the notch 50. The free end 38 of the pry bar portion 46 has a width X1, which is approximately 1.75 inches. In other constructions, the width X1 may be less than or greater than 1.75 inches. During operation of the pry bar portion 46 of the utility bar 10, the notch 50 may be directed towards a fastener, such as a nail, and the beveled surface 54 is wedged under a head of the fastener to facilitate removal of the fastener from a workpiece. The pry bar portion 46 (with or without the beveled surface 54 or notch 50) may be wedged between two objects and leveraged to pry the objects apart.

Figure 1B:
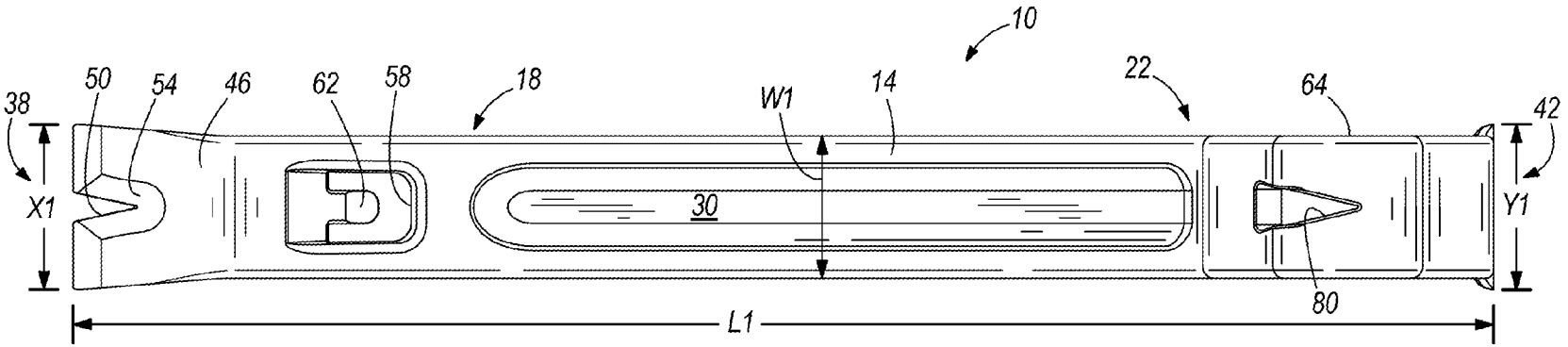
FIG. 1B is a top view of the utility bar of FIG. 1A.
Figure 1C:
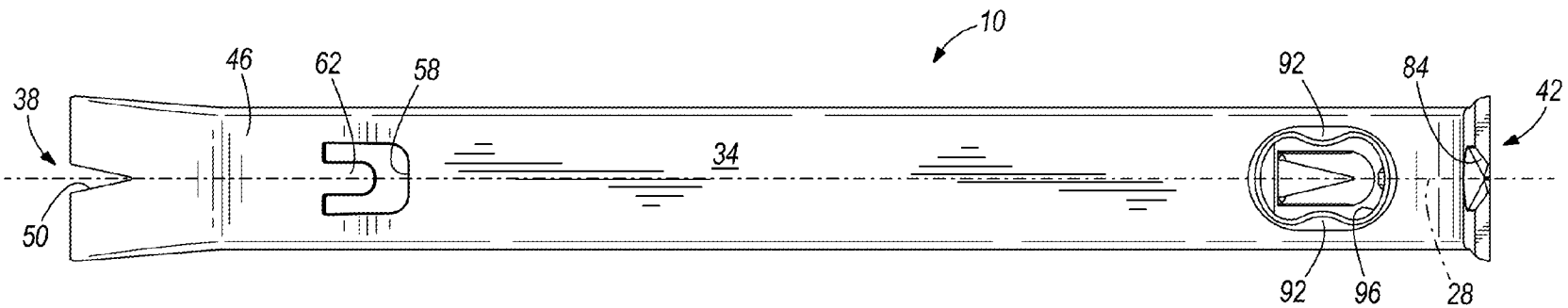
FIG. 1C is a bottom view of the utility bar of FIG. 1A.
Figure 1D:
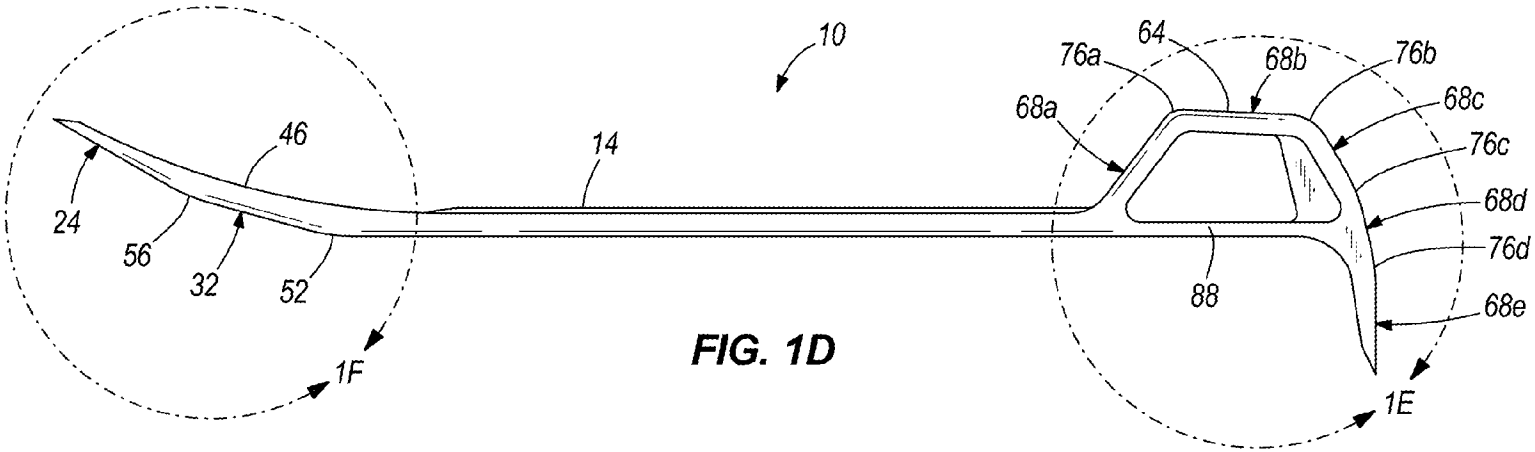
FIG. 1D is a side view of the utility bar of FIG. 1A.
Figure 1E:
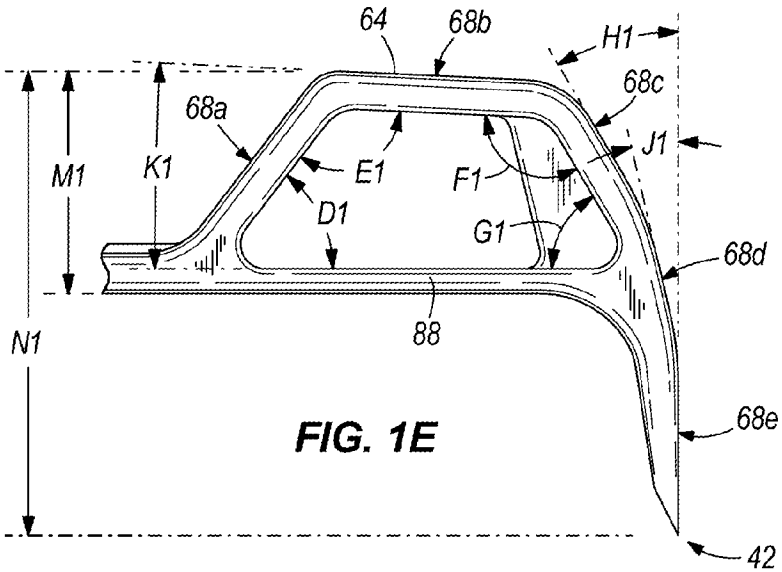
FIG. 1E is an enlarged view of a portion of the utility bar of FIG. 1D.
Figure 1F:
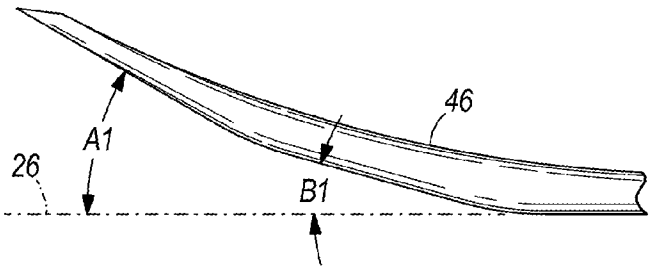
FIG. 1F is an enlarged view of a portion of the utility bar of FIG. 1D.

With particular reference to FIGS. 1D and 1F, the pry bar portion 46 is faceted, including two facets 24, 32 or substantially planar surfaces on the bottom side thereof (i.e., along the bottom surface 34). The facet surface 24 of the pry bar portion 46 forms an angle A1 with the plane 26 of the shank 14. In the illustrated construction, the angle A1 is about 30 degrees and is between the free end 32 of the pry bar portion 46 and the bottom surface 34 of the shank 14. The facet surface 32 adjacent the shank 14 forms a smaller intermediate angle B1 with the plane 26 of the shank 14. In the illustrated construction, the angle B1 is about 15.5 degrees. The bottom 34 of the shank 14 and the adjacent facet intersect at a first pry bar fulcrum edge 52. An intersection of the two facets defines a second pry bar fulcrum edge 56. In other constructions, the angles A1 and B1 may be greater than the angles shown and in yet other constructions, the angles A1 and B1 may be less than the angles shown, and need not be proportional to the angles shown. In yet other constructions, the pry bar portion 46 forms one or more acute angles with the plane 26 having other shapes and configurations. For example, the pry bar portion 46 may have three or more facets and three or more pry bar fulcrum edges.

As best shown in FIGS. 1A-1C, an aperture 58 is positioned entirely within the pry bar portion 46, which generally curves away from the straight shank 14 (i.e., upwardly in the illustrated construction and with reference to FIGS. 1A-1C). In the illustrated construction, the aperture 58 is positioned adjacent to the first end 18 of the shank 14; however, in other constructions, the aperture 58 may be positioned partially in the pry bar portion 46 and partially in the shank 14. In still further constructions, the aperture 58 may be positioned elsewhere on the bar 10. A protrusion 62, or staple puller, extends from the pry bar portion 46 into the aperture 58, giving the aperture 58 a U-shaped appearance. The protrusion 62 has a substantially wedge-shaped portion, which may be used for removing staples. During operation as a staple remover, the wedge-shaped portion of the protrusion 62 is positioned under a staple and the utility bar 10 is rocked about the fulcrum edges 52, 56 on the bottom surface 34 of the pry bar portion 46 to remove the staple from a workpiece. The protrusion 62 is sized and dimensioned to fit under larger conventional staples, such as siding and roof staples.

The head portion 64 extends outwardly from the second end 22 of the shank 14 in a direction generally opposite the pry bar portion 46. In the illustrated construction, the head portion 64 is substantially U-shaped, or arch-shaped, and includes a plurality of facets, which are substantially planar portions of the head portion 64. As shown, the head portion 64 includes five substantially planar facets: a first facet 68*a*, a second facet 68*b*, a third facet 68*c*, a fourth facet 68*d* and a fifth facet 68*e*. The fifth facet 68*e* includes the free end 42, and the head portion 64 tapers to a thin edge at the free end 42. A shank extension 88 extends outwardly from the second end 22 of the shank 14 along the plane 26 of the shank 14, and in the illustrated construction extends between the first facet 68*a* and the fourth facet 68*d*. An angle D1 is defined at an intersection of the first facet 68*a* and the shank extension. The angle D1 is between about 48 degrees and about 56 degrees, and is preferably approximately 52 degrees, as illustrated. However, in other constructions the angle D1 may be greater than 56 degrees or less than 48 degrees.

The fourth and fifth facets 68*d*, 68*e* extend generally downward from the plane 26 (i.e., away from the top surface 30) on a side of the plane 26 opposite the first, second and third facets 68*a*, 68*b*, 68*c*. The second free end 42 of the utility bar 10, at the fifth facet 68*e*, has a width Y1, which is approximately 1.75 inches. In other constructions, the width Y1 may be less than or greater than 1.75 inches.

A first fulcrum edge or round 76*a* and an angle E1 are defined at an intersection of the first and second facets 68*a*, 68*b*. The angle E1 is between about 121 degrees and about 129 degrees, and is preferably approximately 124.9 degrees, as illustrated. However, in some constructions the angle E1 may be greater than 129 degrees or less than 121 degrees.

A second fulcrum edge or round 76*b* and an angle F1 are defined at an intersection of the second and third facets 68*b*, 68*c*. The angle F1 is between about 119 degrees and about 127 degrees, and is preferably approximately 123 degrees, as illustrated. However, in some constructions the angle F1 may be greater than 127 degrees or less than 119 degrees.

A third fulcrum edge or round 76*c* is defined at an intersection of the third and fourth facets 68*c*, 68*d*. A fourth fulcrum edge or round 76*d* is defined at an intersection of the fourth and fifth facets 68*d*, 68*e*. An angle G1 is defined at an intersection of the third facet 68*c* and shank extension 88 (i.e., the plane 26 of the shank 14). The angle G1 is between about 55 degrees and about 63 degrees, and is preferably approximately 59 degrees, as illustrated. However, in some constructions the angle G1 may be greater than 63 degrees or less than 55 degrees.

The third and fifth facets 68*c*, 68*e* define an angle H1 therebetween. The angle H1 is between about 27 and about 35 degrees, and is preferably approximately 31 degrees, as illustrated. However, in some constructions the angle H1 may be greater than 35 degrees or less than 27 degrees.

The fourth and fifth facets 68*d*, 68*e* define an angle J1 therebetween. The angle J1 is between about 9 and about 18 degrees, and is preferably about 13.3 degrees, as illustrated. However, in some constructions the angle J1 may be greater than 18 degrees or less than 9 degrees.

In the illustrated construction, the second facet 68*b* and the plane 26 of the shank 14 define an angle K1 therebetween. The angle K1, as illustrated, is about 2.7 degrees; however, in some constructions, the angle K1 may be greater than or less than 2.7 degrees. In yet other constructions, the second facet 68*b* may be generally parallel to the plane 26.

The head portion 64 includes fulcrum edges, or rounds 76*a*-76*d* between adjacent facets 68*a*-68*e*. In other constructions, the head portion 64 may include fewer or more facets and larger or smaller rounds between the facets. In some constructions, the head portion 64 may have no rounds between facets, i.e., the intersections between facets may be sharp edges. In some constructions, the head portion 64 may be substantially curved.

Referring to FIGS. 1A and 1B, an aperture 80, or nail puller, extends through the first facet 68*a* and the second facet 68*b*. The aperture 80 is used to remove any type of fastener, such as nails. In the illustrated construction, the aperture 80 has a triangular shape having a wide end and a pointed or narrow end and extends across a portion of the first facet 68*a* and a portion of the second facet 68*b*, including an intersection (i.e., the first fulcrum edge or round 76*a*) of the first and second facets 68*a*, 68*b*. The wide end begins in the first facet 68*a* near the first fulcrum edge 76*a* and the pointed end ends in the second facet 68*b*. The aperture 80 tapers from the wide end to the pointed end along the longitudinal axis 28.

The second facet 68*b*, at or near the first fulcrum edge 76*a*, has a height M1 with respect to the bottom surface 34 of the shank 14 and a height N1 with respect to the second free end 42 of the utility bar 10. In the illustrated construction, the height M1 is approximately 1.44 inches and the height N1 is approximately 3 inches. In other constructions, the height M1 may be between about 1 and 2 inches, and the height N1 may be between about 2 and 4 inches. In yet other constructions, the heights M1 and N1 may have other suitable values greater than or less than the values described above. The free end 42 of the head portion 64, or the fifth facet 68*e*, include a second V-shaped notch 84 (FIG. 1A) for removing fasteners, which is similar to the notch 50 located at the opposite free end 38 of the utility bar 10.

Referring to FIGS. 1A and 1C, the bar 10 also includes the shank extension 88, or bottle opener portion. The shank extension 88 extends in the plane 26 from the second end 22 of the shank 14 to the head portion 42, and adds structural strength to the arch-shaped head portion 64. In the illustrated construction, an outermost end of the shank extension 88 connects to the head portion 64 adjacent the fourth facet 68*d*. The shank extension 88 includes an oval-shaped aperture having two inward protrusions 92 (FIG. 1C) defining a dumbbell-shaped aperture 96 for gripping an underside of a bottle cap in order to remove the bottle cap from a bottle. In other constructions, the shank extension 88 may include a substantially rectangular aperture with rounded corners. In further constructions, the shank extension 88 may include one or more apertures having other suitable shapes for removing a bottle cap. In yet further constructions, the shank extension 88 may have no apertures.

During operation, a user holds the shank 14 substantially normal to a support surface in which a fastener is embedded and slides the fifth facet 68*e* against the support surface and underneath the fastener. The second facet 68*b* may be struck to aid in wedging the free end 42, or fifth facet 68*e*, of the head portion 64 under the fastener to be removed. A pivoting or rocking force is then applied by a user to the shank 14 toward the support surface to remove the fastener. The pivoting force is applied in a direction such that the fourth fulcrum edge 76*d* serves as a pivot edge to provide leverage for removing the fastener. When the utility bar 10 pivots a predetermined amount, the third fulcrum edge 76*c* becomes the pivot edge to provide further leverage for removing the fastener. When the utility bar 10 pivots a second predetermined amount, which is greater than the first predetermined amount, the second fulcrum edge 76*b* becomes the pivot edge to provide further leverage for removing the fastener.

The second fulcrum edge 76*b* also acts as a pivot edge when the triangle-shaped aperture 80 is used for removing fasteners. The aperture 80 receives the head of a fastener, such as a nail embedded in a support surface, and the user applies a force to the shank 14 away from the support surface. The second fulcrum edge 76*b* serves as a pivot edge to provide leverage for removing the fastener. The third fulcrum edge 76*c* and the fourth fulcrum edge 76*d* may also become pivot edges, in that order, as the shank 14 of the utility bar 10 is rotated. The free end 42 may become a fifth fulcrum edge, after the fourth fulcrum edge 76*d*, such that the bar 10 may be rotated 180 degrees or more to remove the fastener. The fifth fulcrum edge, or free end 42, faces a direction generally opposite the second facet 68*a* in which the aperture 80 is located. The fulcrum edges increase the ease with which fasteners are removed.

The bottom surface 34 of the pry bar portion 46 acts as a rocking pivot surface when the first V-shaped notch 50 is used and when the staple-remover protrusion 62 or fastener-removing aperture 58 is used. First and second pry bar fulcrum edges 52, 56 on the bottom surface of the pry bar portion 46 provide isolated pivot edges about which the bar 10 pivots during use. The fulcrum edges increase the ease with which fasteners are removed. To use the first V-shaped notch 50, a user slides the beveled surface 54 under a fastener head embedded in a support surface and applies a force to the shank 14 toward or away from the support surface. The fourth and fifth facets 68*d*, 68*e* may be struck to aid in wedging the beveled surface 54 under the fastener head embedded in the support surface. To use the staple-remover protrusion 62 or the free end 38, the staple-remover protrusion 62 or the free end 38 are wedged under a staple embedded in a support surface and a force is applied to the shank 14 away from the support surface.

Figure 2A:
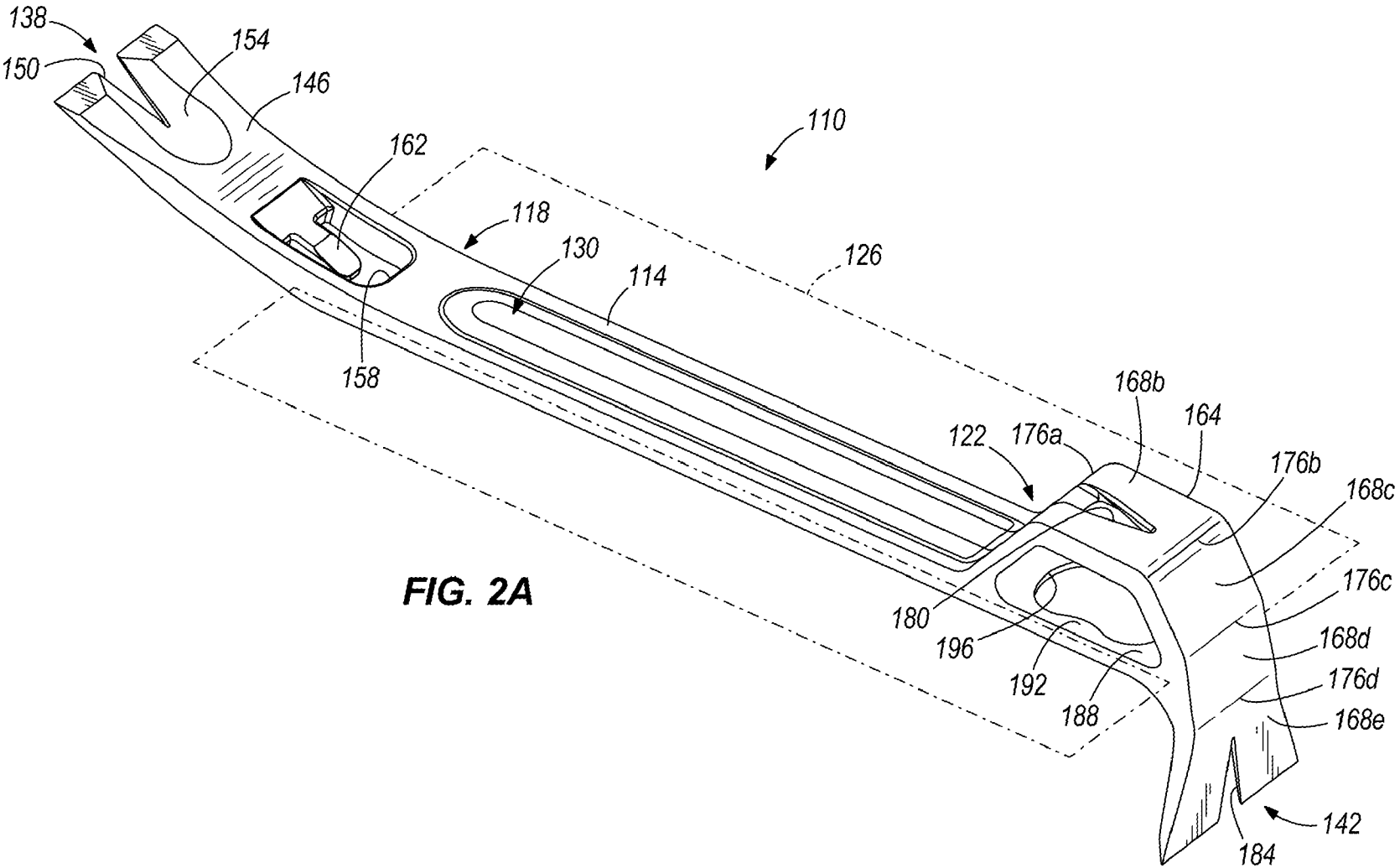
FIG. 2A is a perspective view of a utility bar according to another construction of the invention.
Figure 2B:
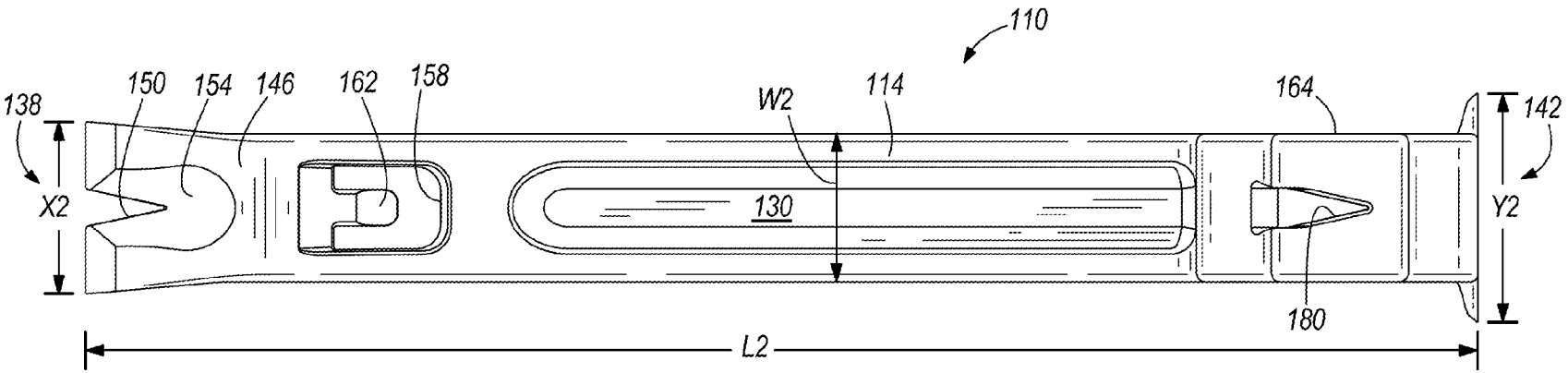
FIG. 2B is a top view of the utility bar of FIG. 2A.

FIGS. 2A-2F illustrate a utility bar 110 according to another construction of the invention. The utility bar 110 is similar to the utility bar 10 shown and described in FIGS. 1A-1F; therefore, like structure will be referred to by like reference numerals plus "100" and only the differences between the two will be discussed herein. The utility bar 110 has an overall length L2 measured between a first free end 138 located on a pry bar portion 146 and a second free end 142 located on a head portion 164. In this construction, the length L2 is approximately 11.5 inches. In other constructions, the utility bar 110 may have an overall length greater than or less than 11.5 inches. The shank 114 of the utility bar 110 also has a width W2, as shown in FIG. 2B, which is approximately 1.28 inches. In other constructions, the width W2 may be less than or greater than 1.28 inches. The free end 138 of the pry bar portion 146 has a width X2, which is approximately 1.41 inches. In other constructions, the width X2 may be less than or greater than 1.41 inches.

Figure 2C:
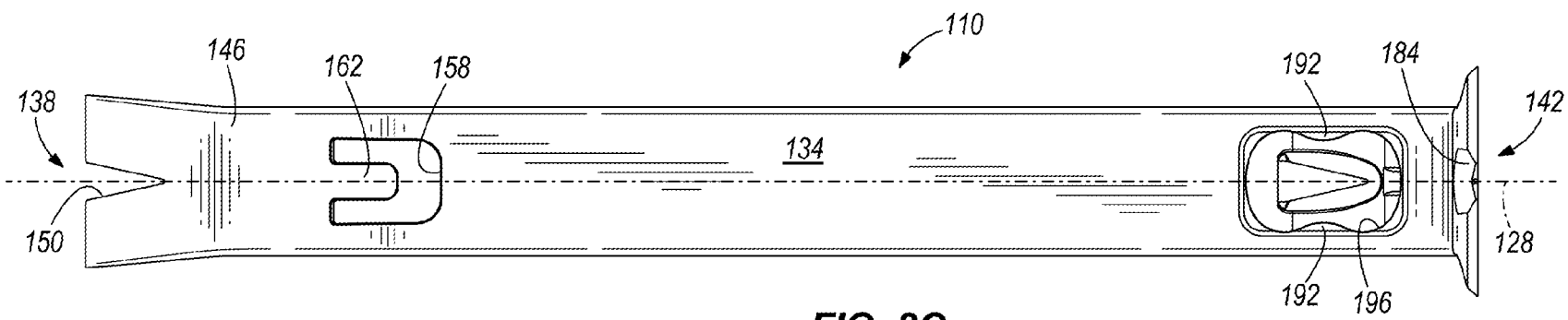
FIG. 2C is a bottom view of the utility bar of FIG. 2A.
Figure 2D:
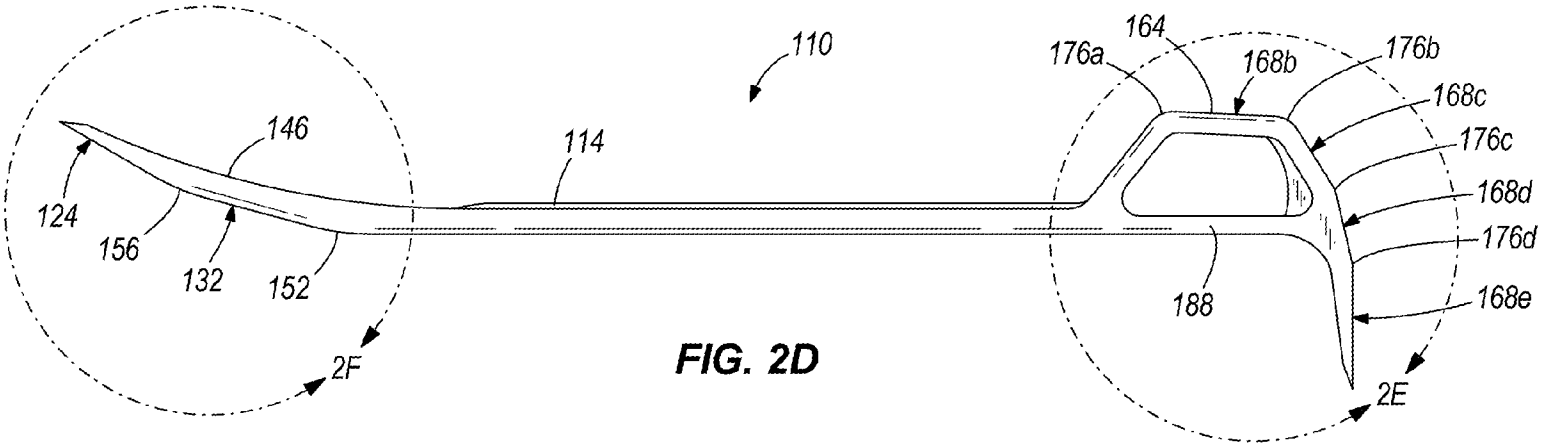
FIG. 2D is a side view of the utility bar of FIG. 2A.
Figure 2E:
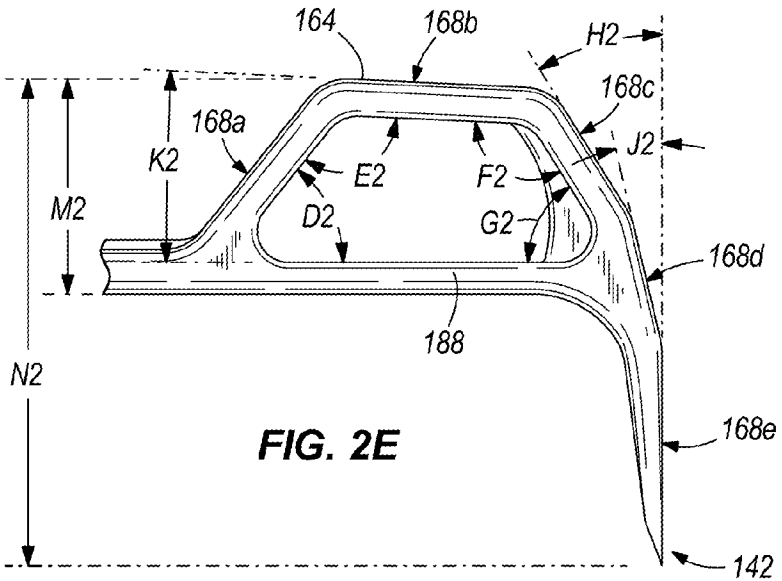
FIG. 2E is an enlarged view of a portion of the utility bar of FIG. 2D.
Figure 2F:
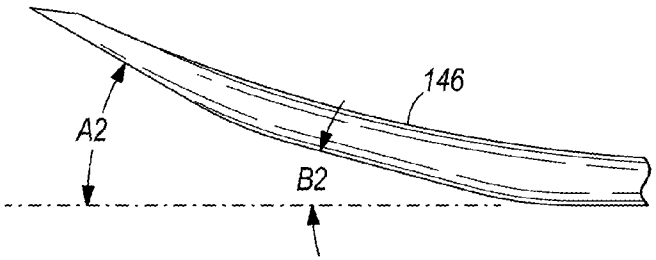
FIG. 2F is an enlarged view of a portion of the utility bar of FIG. 2D.

With particular reference to FIGS. 2D and 2F, the pry bar portion 146 is faceted, including two facets 124, 132 or substantially planar surfaces on the bottom side thereof (i.e., along the bottom surface 134). The facet 124 of the pry bar portion 146 forms an angle A2 with the plane 126 of the shank 114. In the illustrated construction, the angle A2 is about 30 degrees and is between the free end 138 of the pry bar portion 146 and the bottom surface 134 of the shank 114. The facet surface 132 adjacent the shank 14 forms a smaller intermediate angle B2 with respect to the plane 126 of the shank 114. In the illustrated construction, the angle B2 is about 15 degrees. The bottom 134 of the shank 114 and the adjacent facet intersect at a first pry bar fulcrum edge 152. An intersection of the two facets defines a second pry bar fulcrum edge 156. In other constructions, the angles A2 and B2 may be greater than the angles shown and in yet other constructions, the angles A2 and B2 may be less than the angles shown, and need not be proportional to the angles shown. In yet other constructions, the pry bar portion 146 forms one or more acute angles with the plane 126 having other shapes and configurations. For example, the pry bar portion 146 may have three or more facets and three or more pry bar fulcrum edges.

As best shown in FIGS. 2A-2C, an aperture 158 is positioned entirely within the pry bar portion 146, which generally curves away from the straight shank 114 (i.e., upwardly in the illustrated construction and with reference to FIGS. 2A-2C). In the illustrated construction, the aperture 58 is positioned adjacent to the first end 118 of the shank 114; however, in other constructions, the aperture 158 may be positioned partially in the pry bar portion 146 and partially in the shank 114. In still further constructions, the aperture 158 may be positioned elsewhere on the bar 110. A protrusion 162, or staple puller, extends from the pry bar portion 146 into the aperture 158, giving the aperture 158 a U-shaped appearance. The protrusion 162 has a substantially wedge-shaped portion, which may be used for removing staples. The wedge-shaped portion may be positioned under a staple and the utility bar 110 may be rocked about the fulcrum edges 152, 156 on the bottom surface of the pry bar portion 146 to remove the staple from a workpiece. The protrusion 162, or staple puller, is sized and dimensioned to fit under medium sized conventional staples, such as siding and flooring staples.

The head portion 164 extends outwardly from the second end 122 of the shank 114 in a direction generally opposite the pry bar portion 146. In the illustrated construction, the head portion 164 is substantially U-shaped, or arch-shaped, and includes a plurality of facets. As shown, the head portion 164 includes five facets: a first facet 168*a*, a second facet 168*b*, a third facet 168*c*, a fourth facet 168*d* and a fifth facet 168*e*. A shank extension 188 extends outwardly from the second end 122 of the shank 114 along the plane 126 of the shank 114, and in the illustrated construction extends between the first facet 168*a* and the fourth facet 168*d*. An angle D2 is defined at an intersection of the first facet 168*a* and a shank extension 188. The angle D2 is between about 47 degrees and about 55 degrees, and is preferably approximately 51 degrees, as illustrated. However, in some constructions the angle D2 may be greater than 53 degrees or less than 49 degrees.

The fourth and fifth facets 168*d*, 168*e* extend generally downward from the plane 126 (i.e., away from the top surface 130) on a side of the plane 126 opposite the first, second and third facets 168*a*, 168*b*, 168*c*. The second free end 142 of the utility bar 110, at the fifth facet 168*e*, has a width Y2, which is approximately 1.69 inches. In other constructions, the width Y2 may be less than or greater than 1.69 inches.

A first fulcrum edge or round 176 and an angle E2 are defined at an intersection of the first and second facets 168*a*, 168*b*. The angle E2 is between about 122 degrees and about 130 degrees, and is preferably approximately 126.3 degrees, as illustrated. However, in some constructions the angle E2 may be greater than 130 degrees or less than 122 degrees.

A second fulcrum edge or round 176*b* and an angle F2 are defined at an intersection of the second and third facets 168*b*, 168*c*. The angle F2 is between about 123 degrees and about 126 degrees, and is preferably approximately 124.6 degrees, as illustrated. However, in some constructions the angle F2 may be greater than 126 degrees or less than 126 degrees.

A third fulcrum edge or round 176*c* is defined at an intersection of the third and fourth facets 168*c*, 168*d*. A fourth fulcrum edge or round 176*d* is defined at an intersection of the fourth and fifth facets 168*d*, 168*e*. An angle G2 is defined at an intersection of the third facet 168*c* and the plane 126 of the shank 114. The angle G2 is between about 54 degrees and about 62 degrees, and is preferably approximately 58 degrees, as illustrated. However, in some constructions the angle G2 may be greater than 62 degrees or less than 54 degrees.

The third and fifth facets 168*c*, 168*e* define an angle H2 therebetween. The angle H2 is between about 28 and about 36 degrees, and is preferably approximately 32 degrees, as illustrated. However, in some constructions the angle H2 may be greater than 33 or less than 30 degrees.

The fourth and fifth facets 168*d*, 168*e* define an angle J2 therebetween. The angle J2 is between about 9 and about 17 degrees, and is preferably about 13.3 degrees, as illustrated. However, in some constructions the angle J2 may be greater than 17 degrees or less than 9 degrees.

Referring to FIG. 2E, the second facet 168*b*, at or near the first fulcrum edge 176*a*, has a height M2 with respect to the bottom surface 134 of the shank 114 and a height N2 with respect to the second free end 142 of the utility bar 110. In the illustrated construction, the height M2 is approximately 1.1 inches, and the height N2 is approximately 2.47 inches. In other constructions, the height M2 may be between about 0.5 and 1.5 inches, and the height N2 may be between about 2 and 3 inches. In yet other constructions, the heights M2 and N2 may have other suitable values greater than or less than the values described above. The free end 142 of the head portion 164, or the fifth facet 168*e*, includes a second V-shaped notch 184 for removing fasteners (best shown in FIG. 2A) and is similar to the notch 150 located opposite the free end 138 of the utility bar 110.

In operation, the utility bar 110 operates substantially the same as the utility bar 10 described above.

FIGS. 3A-3F illustrate a utility bar 210 according to another construction of the invention. The utility bar 210 is similar to the utility bar 110 shown and described in FIGS. 2A-2F; therefore, like structure will be referred to by like reference numerals plus "200" and only the differences between the bars will be discussed herein.

Figure 3A:
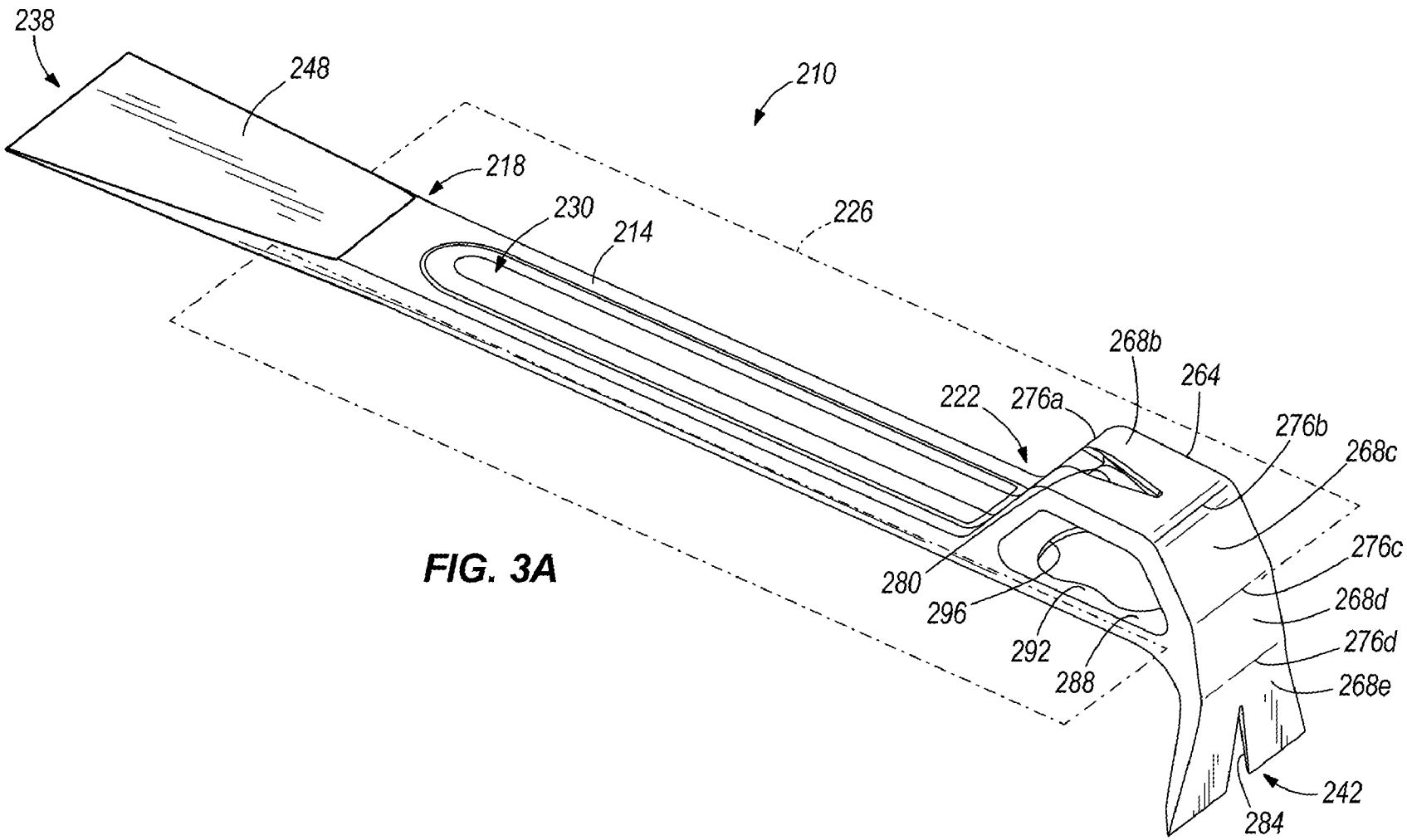
FIG. 3A is a perspective view of a utility bar according to yet another construction of the invention.
Figure 3B:
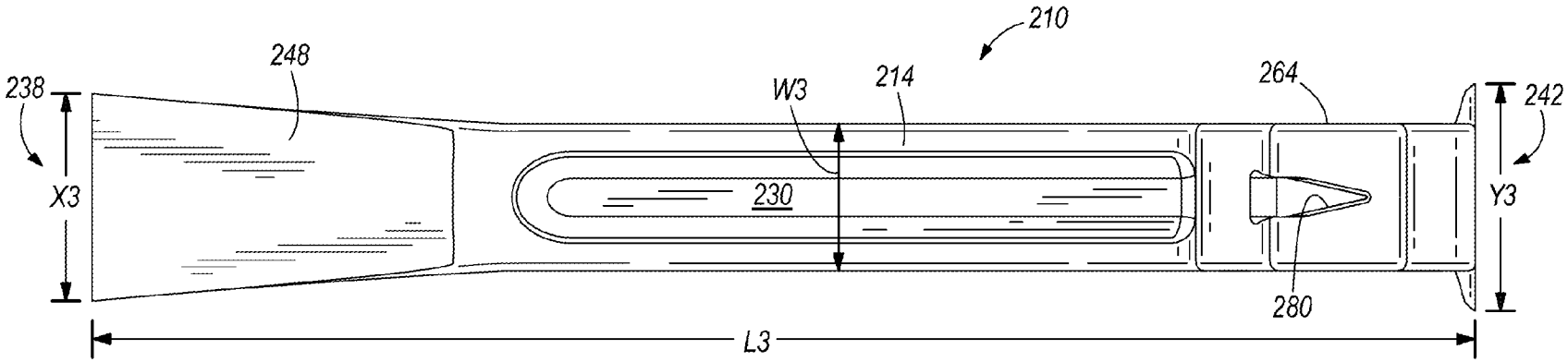
FIG. 3B is a top view of the utility bar of FIG. 3A.
Figure 3C:
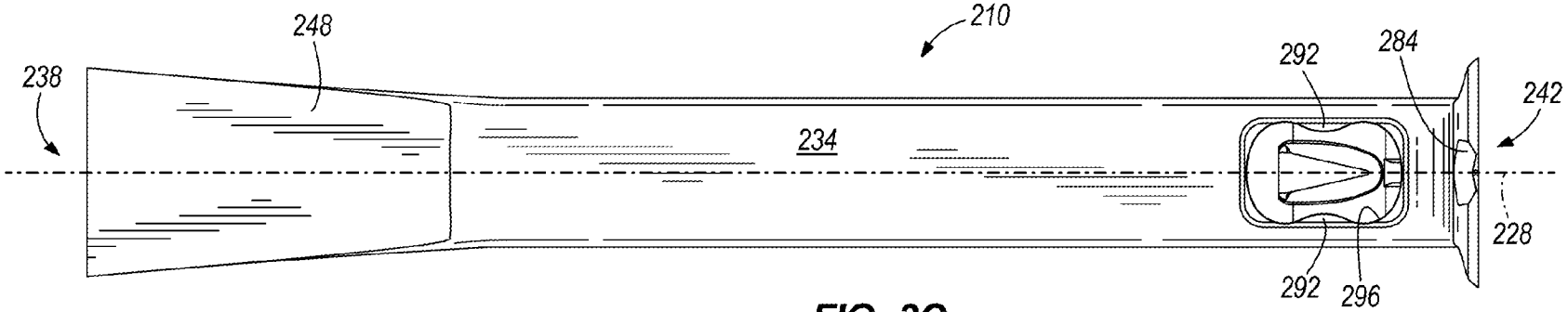
FIG. 3C is a bottom view of the utility bar of FIG. 3A.

The utility bar 210 includes a substantially straight shank 214 having a first end 218 and a second end 222 and defining a plane 226. A glazer portion 248 extends from the first end 218 of the shank 214, and a head portion 264 extends from the second end 222 of the shank 214. The utility bar 210 has a top surface 230 and a bottom surface 234. As shown in FIG. 3B, the utility bar 210 has an overall length L3 measured between a first free end 238 located on the pry bar portion 246 and a second free end 242 located on the head portion 264. In the illustrated construction, the length L3 is approximately 11.5 inches. In other constructions, the utility bar 210 may have other overall lengths greater than or less than 11.5 inches. The shank 214 of the utility bar 210 also has a width W3, as shown in FIG. 3B, which is approximately 1.28 inches. In other constructions, the width W3 may be less than or greater than 1.28 inches.

Figure 3D:
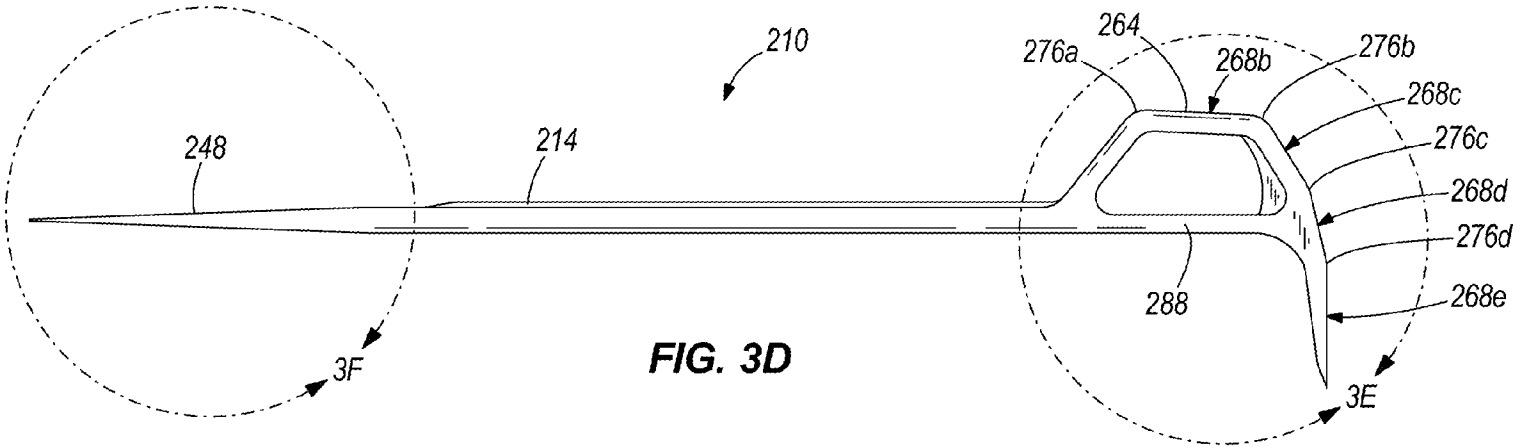
FIG. 3D is a side view of the utility bar of FIG. 3A.
Figure 3E:
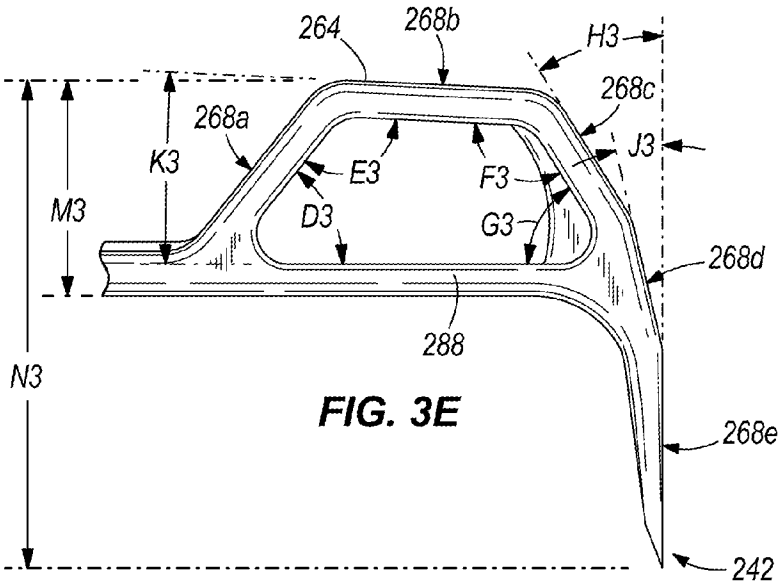
FIG. 3E is an enlarged view of a portion of the utility bar of FIG. 3D.
Figure 3F:
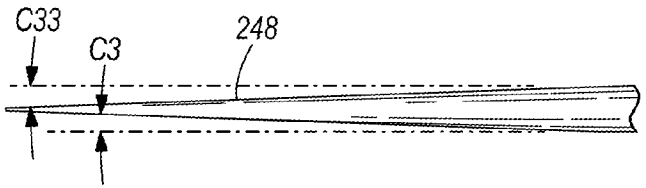
FIG. 3F is an enlarged view of a portion of the utility bar of FIG. 3D.

The glazer portion 248 has a tapered shape that extends generally centered about the plane 226 and tapers to a point or thin edge at the first free end 238. The first free end 238 has a width X3, which is approximately 1.73 inches. In other constructions, the width X3 may be less than or greater than 1.73 inches. With particular reference to FIGS. 3D and 3F, the tapered glazer portion 246 forms an angle C3 with the bottom surface 234 of the shank 214, and an angle C33 with the top surface 230 of the shank 214. The angles C3 and C33 are approximately between 1 and 3 degrees. In the illustrated construction, the angle C3 is about 2 degrees and the angle C33 is about 2 degrees. In some constructions, the angles C3 and C33 may be greater than 3 degrees or less than 1 degree.

In operation, the head portion 264 functions substantially the same way as the head portion 64 described above. The glazer portion 248 of the utility bar 210 is wedged under or between objects and leveraged for prying, and may be used for scraping.

FIGS. 4A-4F illustrate a utility bar 310 according to another construction of the invention. The utility bar 310 is similar to the utility bar 10 shown and described in FIGS. 1A-1F; therefore, like structure will be referred to by like reference numerals plus "300" and only the differences between the two will be discussed herein.

The utility bar 310 has an overall length L4 measured between a first free end 338 located on a pry bar portion 346 and a second free end 342 located on a head portion 364. In the second construction, the length L4 is approximately 7.5 inches. In other constructions, the utility bar 310 may have other an overall length greater than or less than 7.5 inches. The shank 314 of the utility bar 310 also has a width W4, as shown in FIG. 4B, which is approximately 1 inch. In other constructions, the width W4 may be less than or greater than 1 inch. A free end 338 of the pry bar portion 346 has a width X4, which is approximately 1 inch. In other constructions, the width X4 may be less than or greater than 1 inch.

Figure 4A:
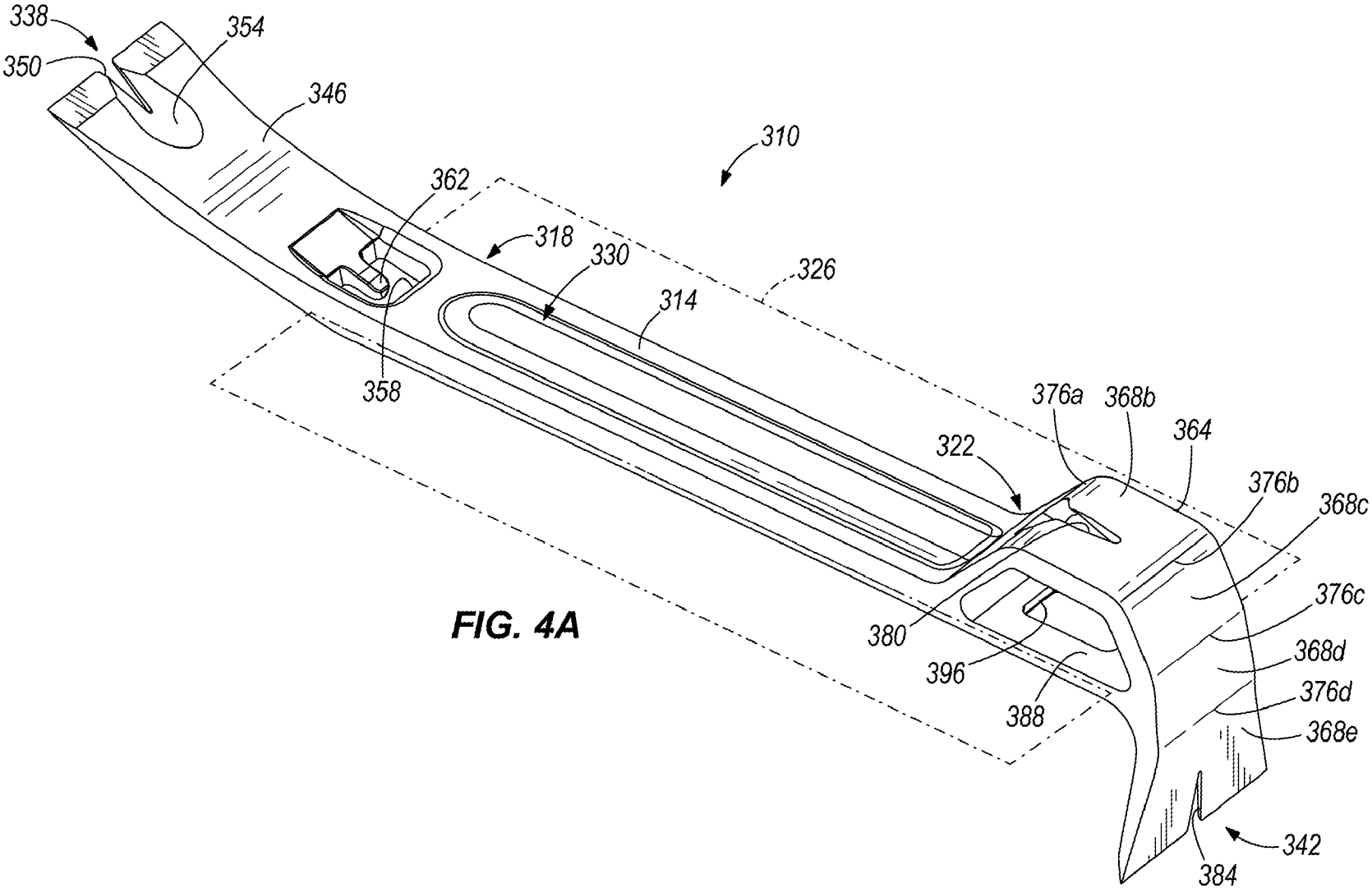
FIG. 4A is a perspective view of a utility bar according to one construction of the invention.
Figure 4B:
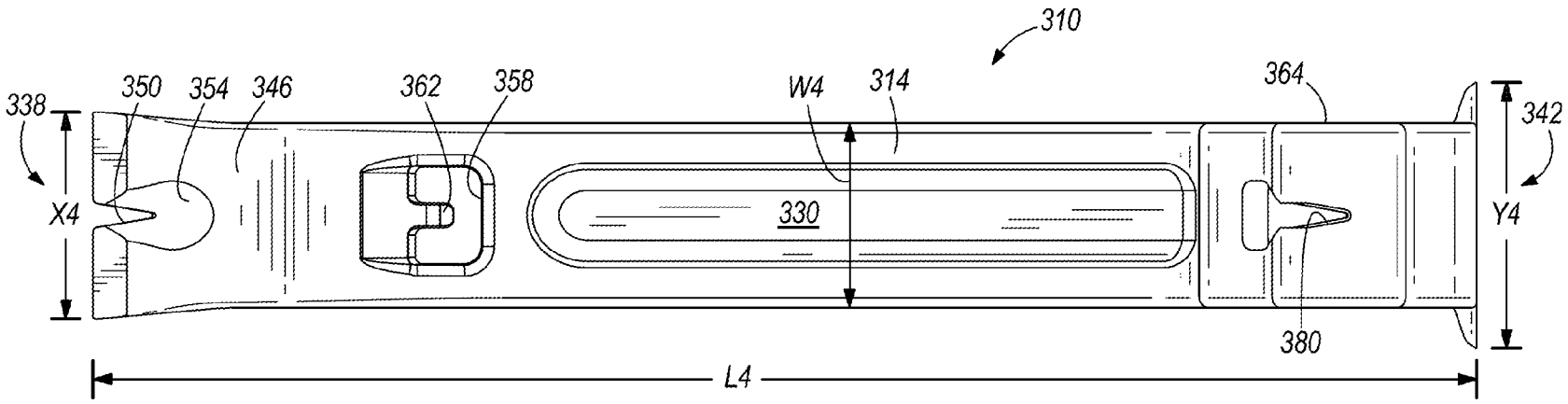
FIG. 4B is a top view of the utility bar of FIG. 4A.
Figure 4C:
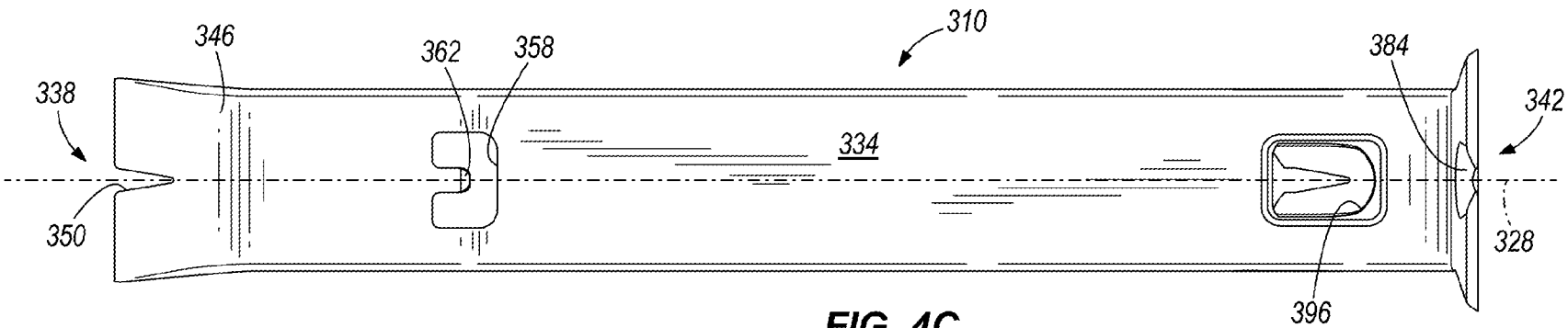
FIG. 4C is a bottom view of the utility bar of FIG. 4A.
Figure 4D:
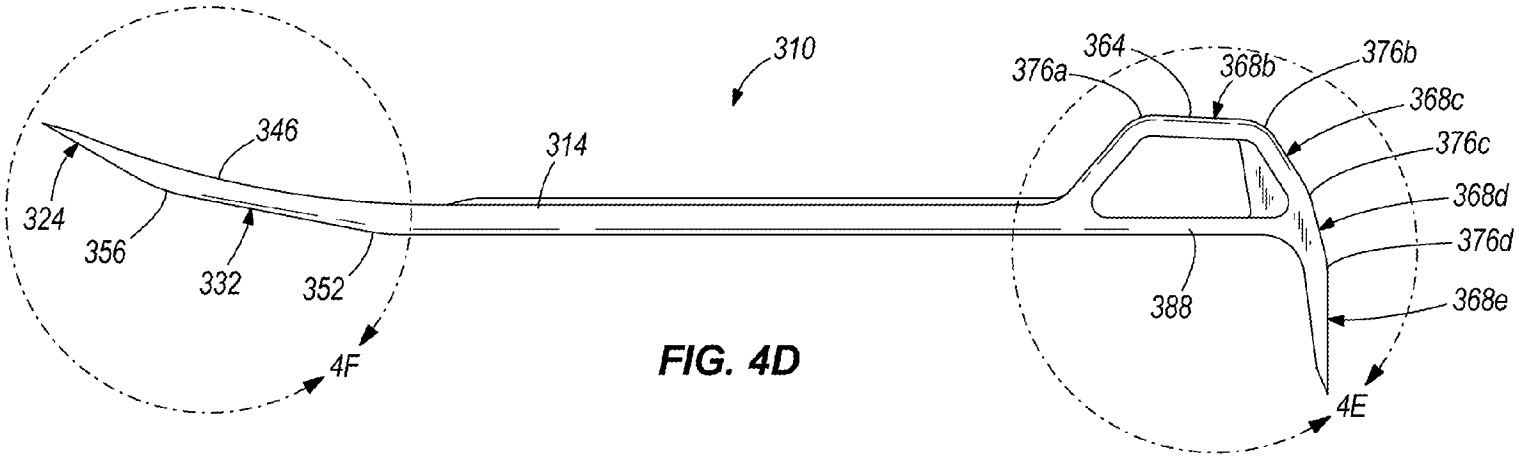
FIG. 4D is a side view of the utility bar of FIG. 4A.
Figure 4E:
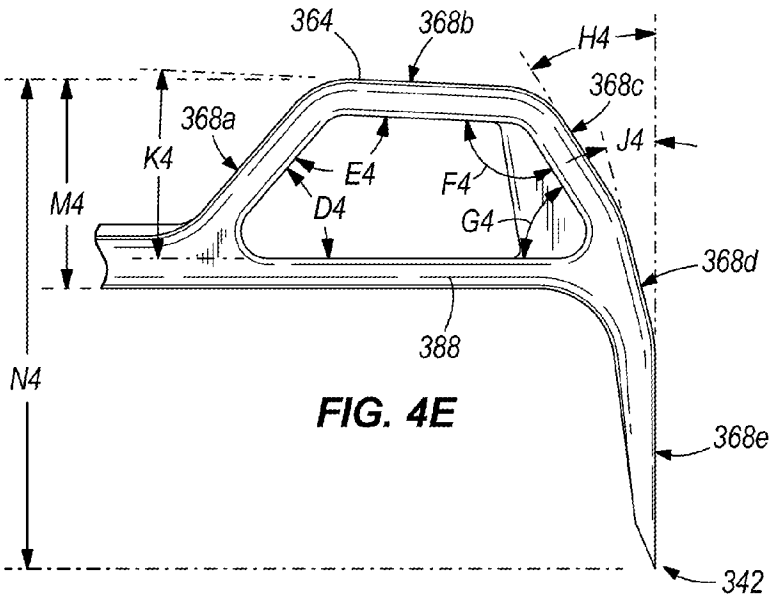
FIG. 4E is an enlarged view of a portion of the utility bar of FIG. 4D.
Figure 4F:
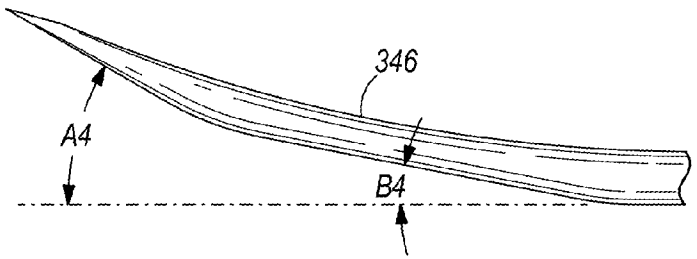
FIG. 4F is an enlarged view of a portion of the utility bar of FIG. 4D.

With particular reference to FIGS. 4D and 4F, the pry bar portion 346 is faceted, having two facets 324, 332 or substantially planar surfaces on the bottom side thereof (i.e., along the bottom surface 334). The facet surface 324 of the pry bar portion 346 forms an angle A4 with the plane 326 of the shank 314 and is positioned between the free end 338 of the pry bar portion 346 and the bottom surface 334 of the shank portion 314. In the illustrated construction, the angle A4 is about 30 degrees. The facet 332 forms a smaller intermediate angle B4 with respect to the plane 326 of the shank 314. In the illustrated construction, the angle B4 is about 11 degrees. The bottom 334 of the shank 314 and the adjacent facet intersect at a first pry bar fulcrum edge 352. An intersection of the two facets defines a second pry bar fulcrum edge 356. In other constructions, the angles A4 and B4 may be greater than the angles shown and in yet other constructions, the angles A4 and B4 may be less than the angles shown, and need not be proportional to the angles shown. In yet other constructions, the pry bar portion 346 may form one or more acute angles with the plane 326 having other shapes and configurations. For example, the pry bar portion 346 may have three or more facets and three or more pry bar fulcrum edges.

Best shown in FIGS. 4A-4C, an aperture 358 is positioned entirely within the pry bar portion 346, which generally curves away from the straight shank 314, and is adjacent to the first end 318 of the shank 314. However, in other constructions, the aperture 358 may be positioned partially in the pry bar portion 346 and partially in the shank 314. In still further constructions, the aperture 358 may be positioned elsewhere on the bar 310. A protrusion 362 extends from the pry bar portion 346 into the aperture 358, giving the aperture 358 a U-shaped appearance. The protrusion 362 has a substantially wedge-shaped portion, which may be used for removing staples. The wedge-shaped portion may be positioned under a staple and the utility bar 310 may be rocked about the fulcrum edges 352, 356 on the bottom surface of the pry bar portion 346 to remove the staple from a workpiece. The protrusion 362, or staple puller, is sized and dimensioned to fit under smaller conventional staples, such as finish and upholstery staples.

The head portion 364 extends outwardly from the second end 322 of the shank 314 in a direction generally opposite the pry bar portion 346. In the illustrated construction, the head portion 364 is substantially U-shaped, or arch-shaped, and includes a plurality of facets. As shown, the head portion 364 includes five facets: a first facet 368*a*, a second facet 368*b*, a third facet 368*c*, a fourth facet 368*d* and a fifth facet 368*e*. An angle D4 is defined at an intersection of the first facet 368*a* and a shank extension 388, which extends outwardly from the second end 322 of the shank 314 along the plane 326 of the shank 314. In the illustrated construction, the angle D4 is between about 45 degrees and about 53 degrees, and is preferably approximately 49 degrees. However, in some constructions the angle D4 may be greater than 53 degrees or less than 45 degrees.

The fourth and fifth facets 368*d*, 168*e* extend generally downward from the plane 326 on a side of the plane 326 opposite the first, second and third facets 368*a*, 368*b*, 368*c*. The second free end 342 of the fifth facet 368*e* has a width Y4, which is approximately 1.44 inches. In other constructions, the width Y4 may be less than or greater 1.44 inches.

A first fulcrum edge or round 376 and an angle E4 are defined at an intersection of the first and second facets 368*a*, 368*b*. In the illustrated construction, the angle E4 is between about 124 degrees and about 132 degrees, and is preferably approximately 128 degrees. However, in some constructions the angle E4 may be greater than 132 degrees or less than 124 degrees.

A second fulcrum edge or round 376*b* and an angle F4 is defined at an intersection of the second and third facets 368*b*, 368*c*. The angle F4 is between about 124 degrees and about 132 degrees, and is preferably approximately 128 degrees, as illustrated. However, in some constructions the angle F4 may be greater than 132 degrees or less than 124 degrees.

A third fulcrum edge or round 376*c* is defined at an intersection of the third and fourth facets 368*c*, 368*d*. A fourth fulcrum edge or round 376*d* is defined at an intersection of the fourth and fifth facets 368*d*, 368*e*. An angle G4 is defined at an intersection of the third facet 368*c* and the plane 326 of the shank 314. The angle G4 is between about 54 degrees and about 62 degrees, and is preferably approximately 58 degrees, as illustrated. However, in some constructions the angle G4 may be greater than 62 degrees or less than 54 degrees.

The third and fifth facets 368*c*, 368*e* define an angle H4 therebetween. The angle H4 is between about 28 and about 36 degrees, and is preferably approximately 32.5 degrees, as illustrated. However, in some constructions the angle H4 may be greater than 36 degrees or less than 28 degrees.

The fourth and fifth facets 368*d*, 368*e* define an angle J4 therebetween. The angle J4 is between about 10 and about 18 degrees, and is preferably about 14.5 degrees, as illustrated. However, in some constructions the angle J4 may be greater than 18 degrees or less than 10 degrees.

In the illustrated construction, the second facet 368*b* and the plane 326 of the shank 314 define an angle K4 therebetween. The angle K4, as illustrated, is about 2.7 degrees; however, in some constructions, the angle K4 may be greater than or less than 2.7 degrees. In yet other constructions, the second facet 368*b* may be generally parallel to the plane 326.

The head portion 364 includes fulcrum edges, or rounds 376*a*-376*d* between the facets 368*a*-368*e*. In other constructions, the head portion 364 may include fewer or more facets and larger or smaller rounds between facets. In some constructions, the head portion 364 may have no rounds between facets, i.e., sharp edges. In some constructions, the head portion 364 may be substantially curved.

The second facet 368*b*, at or near the first fulcrum edge 376*a*, as a height M4 with respect to the bottom 334 of the shank 314 of approximately 0.7 inches, and a height N4 with respect to the second free end 342 of approximately 1.63 inches. In other constructions, the height M4 may be between about 0.2 and 1.3 inches, and the height N4 may be between about 1.2 and 2.1 inches. In yet other constructions, the heights M4 and N4 may have other suitable values greater than or less than the range above. The free end 342 of the head portion 364, such as the fifth facet 368*e*, includes a second V-shaped notch 384 for removing fasteners (best shown in FIG. 4A).

The bar 310 also includes the shank extension 388, or bottle opener portion. The shank extension 388 extends from the second end 322 of the shank 314 in the plane 326 to the head portion 342, and adds structural strength to the arch-shaped head portion 364. In the illustrated construction, an outermost end of the shank extension 388 connects to the head portion 364 adjacent the fourth facet 368*d*. The shank extension 388 includes substantially rectangular aperture with rounded corners for gripping an underside of a bottle cap for the removal of a bottle cap from a bottle. In further constructions, the shank extension 388 may include one or more apertures having other suitable shapes for removing a bottle cap, such as the dumbbell shape described above.

Figure 5A:
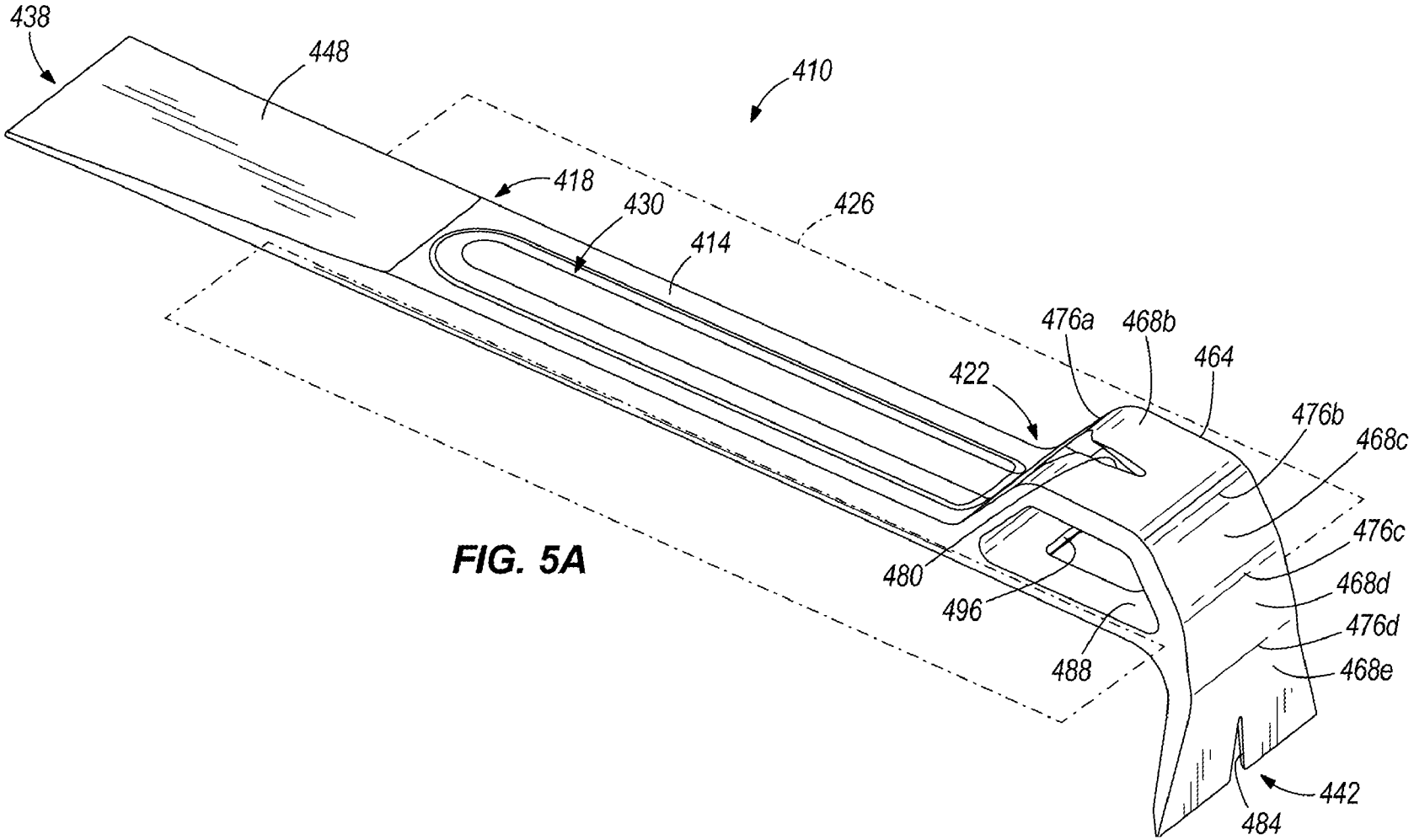
FIG. 5A is a perspective view of a utility bar according to another construction of the invention.
Figure 5B:
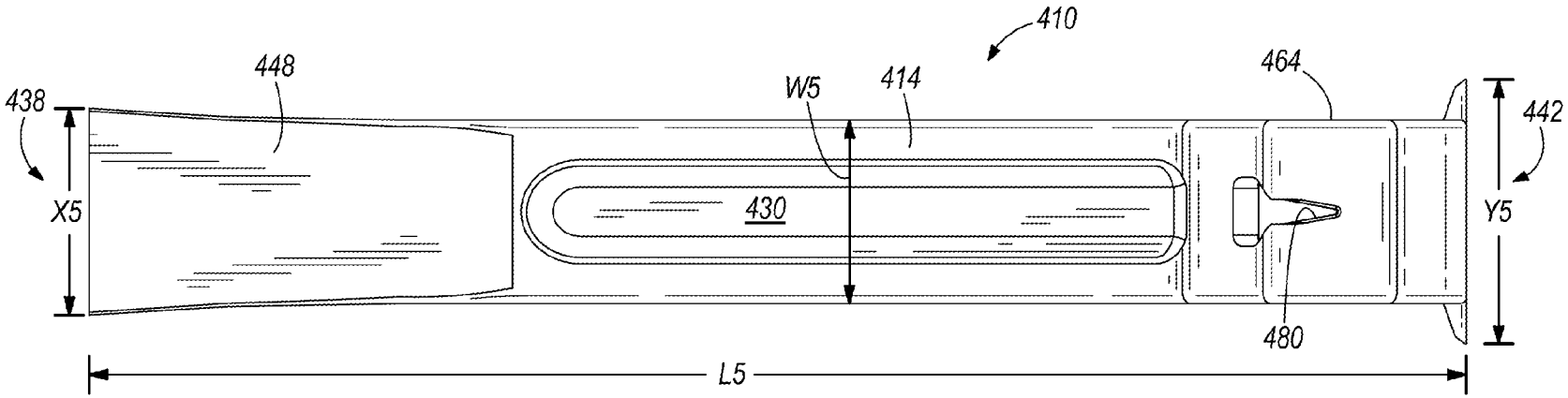
FIG. 5B is a top view of the utility bar of FIG. 5A.
Figure 5C:
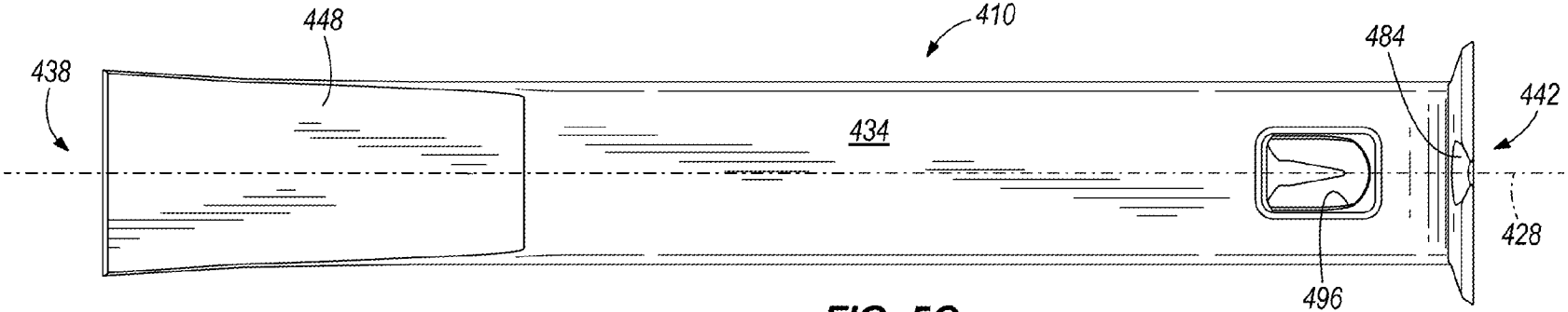
FIG. 5C is a bottom view of the utility bar of FIG. 5A.

FIGS. 5A-5F illustrate a utility bar 410 according to another construction of the invention. The utility bar 410 is similar to the utility bar 210, 310 shown and described in FIGS. 3A-3F, 4A-4F, respectively; therefore, like structure will be referred to by like reference numerals plus "400" and only the differences between the bars will be discussed herein. The utility bar 410 includes a substantially straight shank 414 having a first end 418 and a second end 422 and defining a plane 426. A glazer portion 448 extends from the first end 418 of the shank 414, and a head portion 464 extends from the second end 422 of the shank 414. The utility bar 410 has a top surface 430 and a bottom surface 434. As shown in FIG. 5B, the utility bar 410 has an overall length L5 measured between a first free end 438 located on the pry bar portion 446 and a second free end 442 located on the head portion 464. In the illustrated construction, the length L5 is approximately 7.5 inches. In other constructions, the utility bar 410 may have other overall lengths greater than or less than 7.5 inches. The shank 414 of the utility bar 410 also has a width W5, as shown in FIG. 5B, which is approximately 1 inch. In other constructions, the width W5 may be less than or greater than 1 inch.

The glazer portion 448, which is similar to the glazer portion 248 described above with respect to FIGS. 3A-3F, extends from the first end 418 of the straight shank 414 and has a tapered shape that extends generally centered about the plane 426 and tapers to a point or thin edge at the first free end 438. The first free end 438 has a width X5, which is approximately 1 inch. In other constructions, the width X5 may be less than or greater than 1 inch.

Figure 5D:
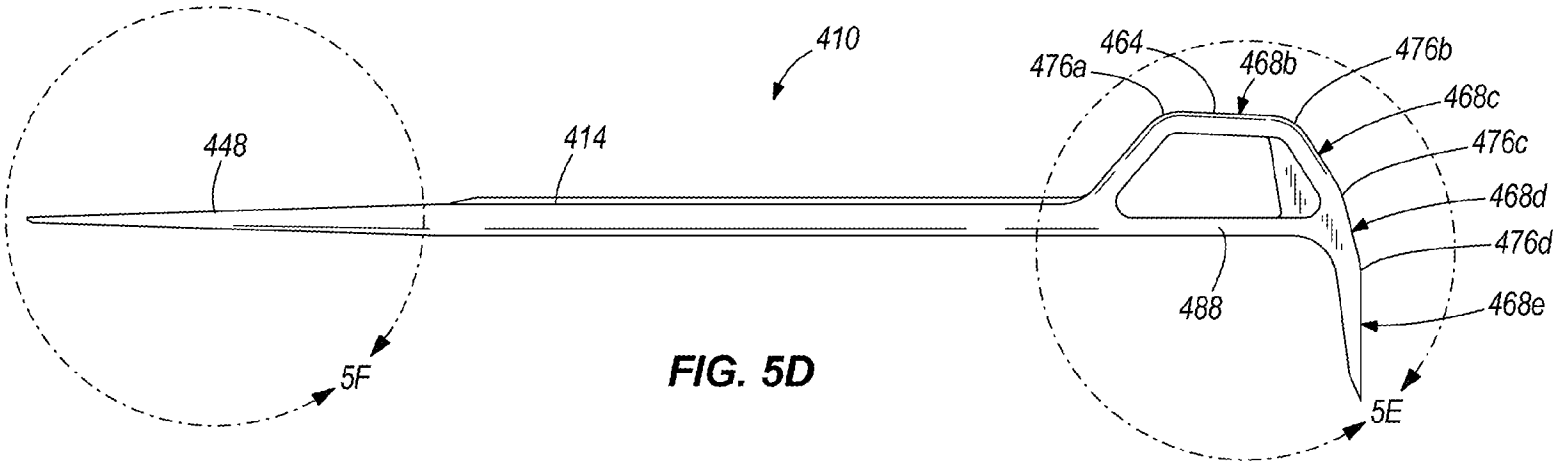
FIG. 5D is a side view of the utility bar of FIG. 5A.
Figure 5E:
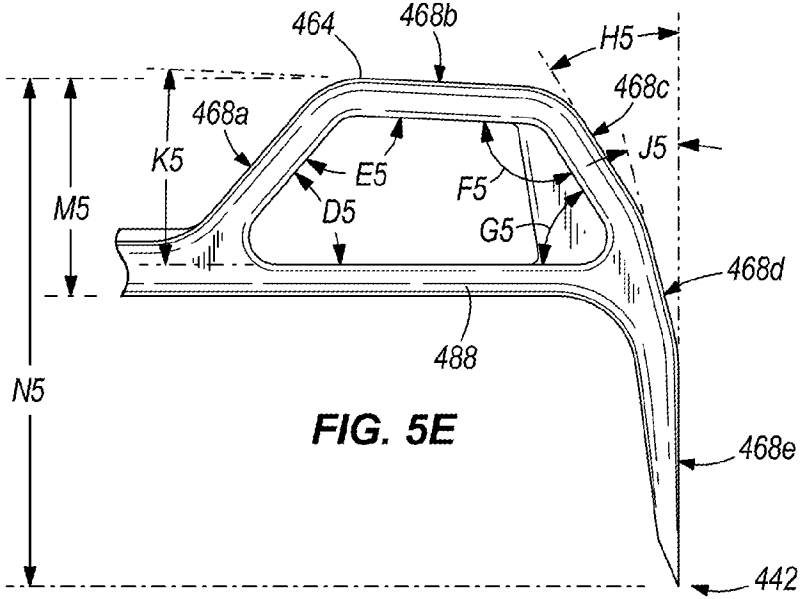
FIG. 5E is an enlarged view of a portion of the utility bar of FIG. 5D.
Figure 5F:
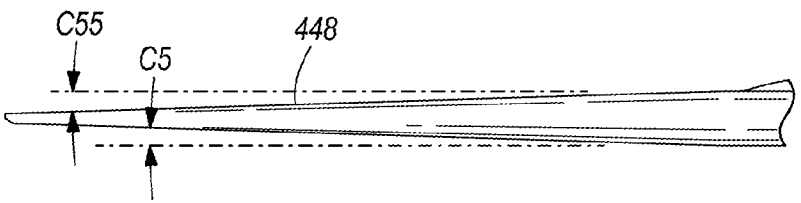
FIG. 5F is an enlarged view of a portion of the utility bar of FIG. 5D.

With particular reference to FIGS. 5D and 5F, the tapered glazer portion 446 forms an angle C5 with the bottom surface 434 of the shank 414, and an angle C55 with the top surface 430 of the shank 414. The angles C5 and C55 are approximately between 1 and 4 degrees. In the illustrated construction, the angle C5 is about 2 degrees and the angle C55 is about 3 degrees. In some constructions, the angles C5 and C55 may be greater than 4 degrees and in other constructions, the angles C5 and C55 may be less 1 degree.

In operation, the head portion 464 functions substantially the same way as the head portion 364 described above. The glazer portion 448 of the utility bar 410 may be wedged under or between objects and leveraged for prying, and may be used for scraping.

Figure 6A:
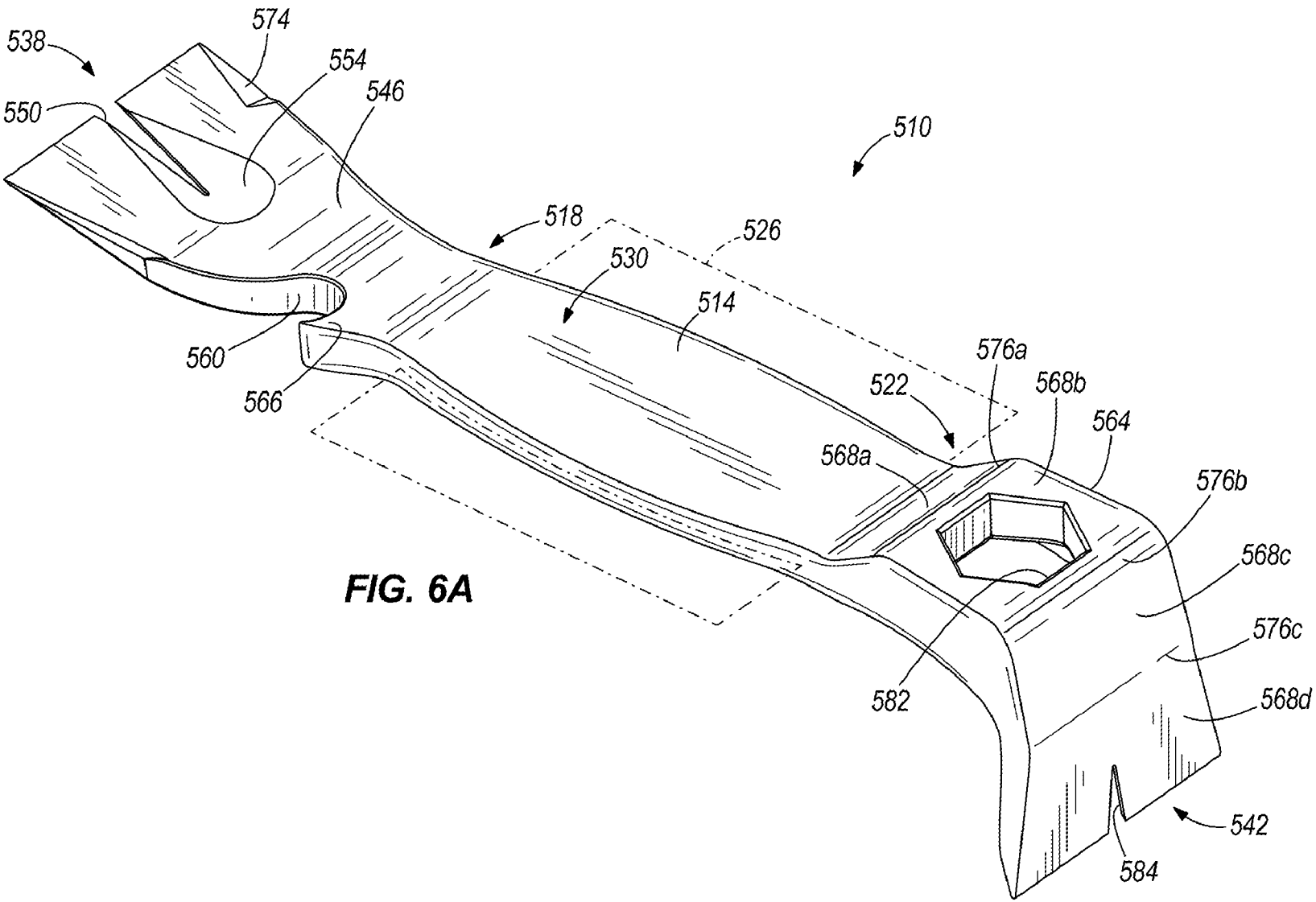
FIG. 6A is a perspective view of a utility bar according to yet another construction of the invention.
Figure 6B:
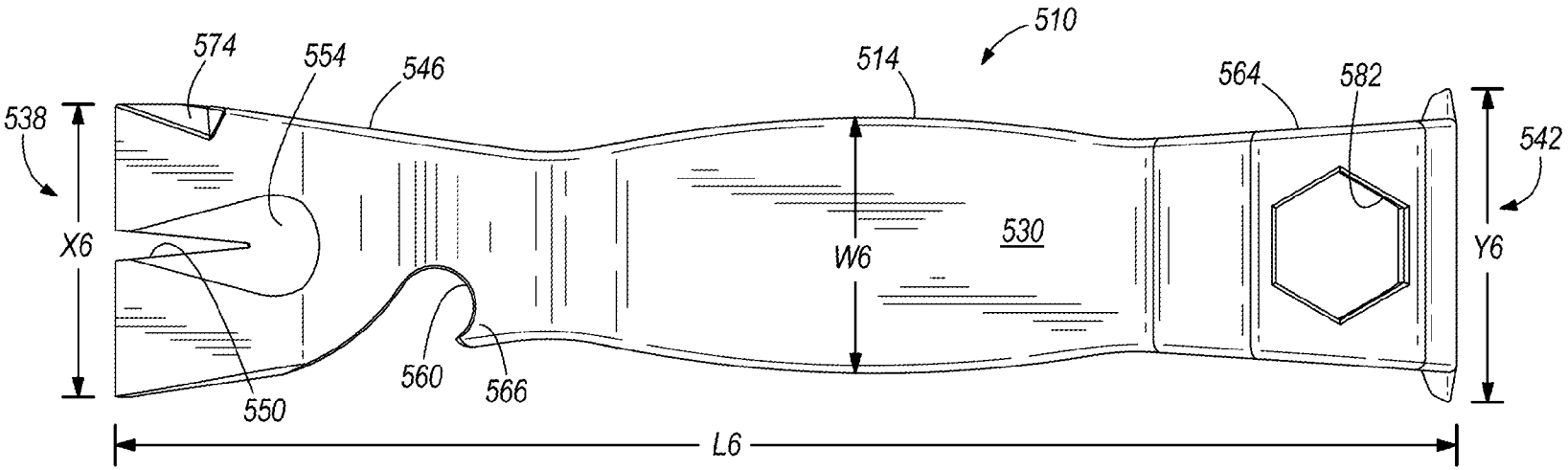
FIG. 6B is a top view of the utility bar of FIG. 6A.

FIGS. 6A-6F illustrate a utility bar 510 according to another construction of the invention. The utility bar 510 includes a substantially straight shank 514 having a first end 518 and a second end 522 and defining a plane 526. A pry bar portion 546 extends from the first end 518 of the shank 514, and a head portion 564 extends from the second end 522 of the shank 514. The utility bar 510 has a top surface 530 and a bottom surface 534. As shown in FIG. 6B, the utility bar 510 has an overall length L6 measured between a first free end 538 located on the pry bar portion 546 and a second free end 542 located on the head portion 564. In the illustrated construction, the length L6 is approximately 15 inches. In other constructions, the utility bar 510 may have other an overall length greater than or less than 15 inches. The shank 514 of the utility bar 510 also has a width W6, as shown in FIG. 6B, which is approximately 1 inch at the widest point. In other constructions, the width W6 may be less than or greater than 1 inch. The shank 514 is slightly more narrow, i.e., has a smaller width, at the first and second ends 518, 522 for ergonomic benefit to a user when gripping the shank 514.

The pry bar portion 546 extends from the first end 518 of the straight shank 514 and has a notch 550 at the first free end 538. The notch 550 is V-shaped and a beveled surface 554 is positioned adjacent the notch 550, similar in structure and function to the notch 50 discussed above with respect to the utility bar 10. The first free end 538 of the pry bar portion 546 has a width X6, which is approximately 1.2 inches. In other constructions, the width X6 may be less than or greater than 1.2 inches.

Adjacent the first free end 538 and on one side of the notch 550 is a thin edge 574. The edge 574 has a thickness that is less than a thickness of the pry bar portion 546, is cut out of the pry bar portion 546 and tapers from the top and bottom surfaces of the pry bar portion 546 to converge at a sharp edge. The edge 574 is useful for cutting through materials, such as tape on boxes.

Figure 6C:
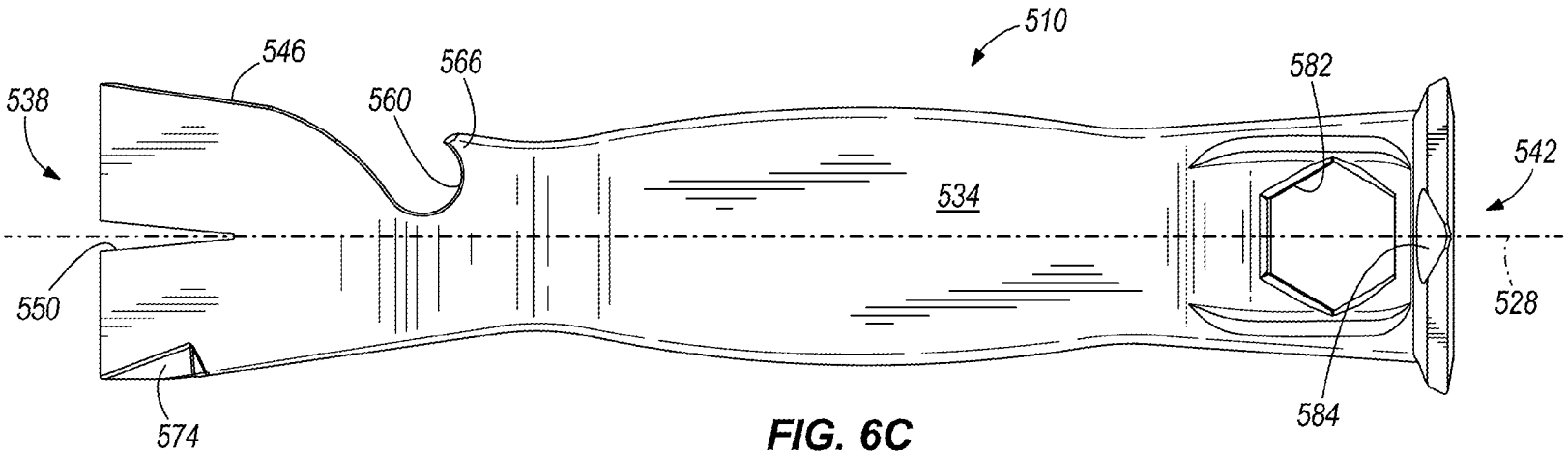
FIG. 6C is a bottom view of the utility bar of FIG. 6A.
Figure 6D:
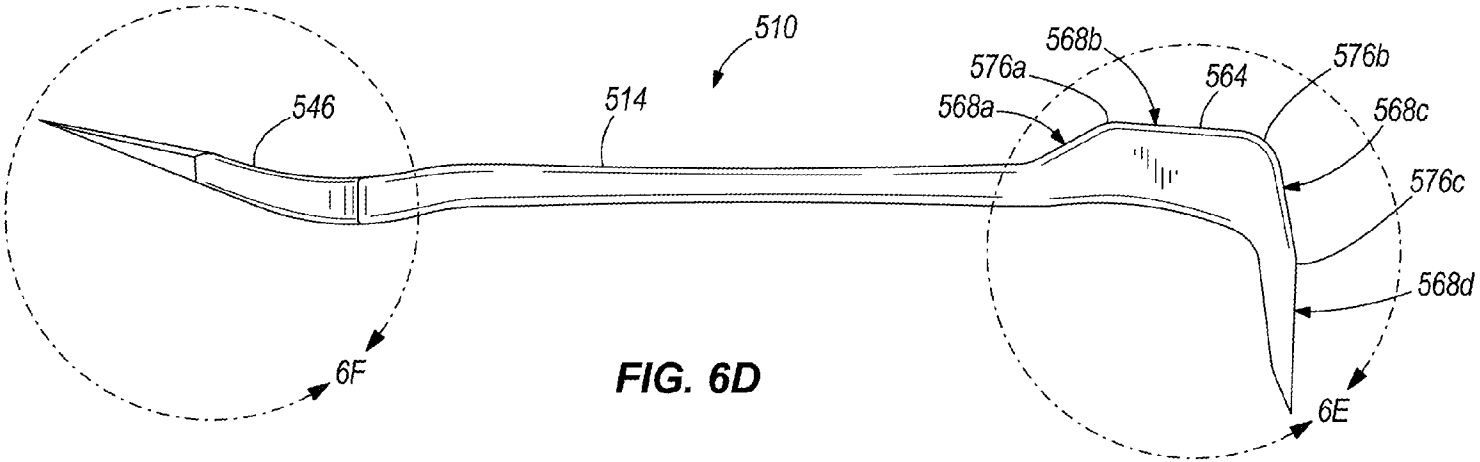
FIG. 6D is a side view of the utility bar of FIG. 6A.
Figure 6E:
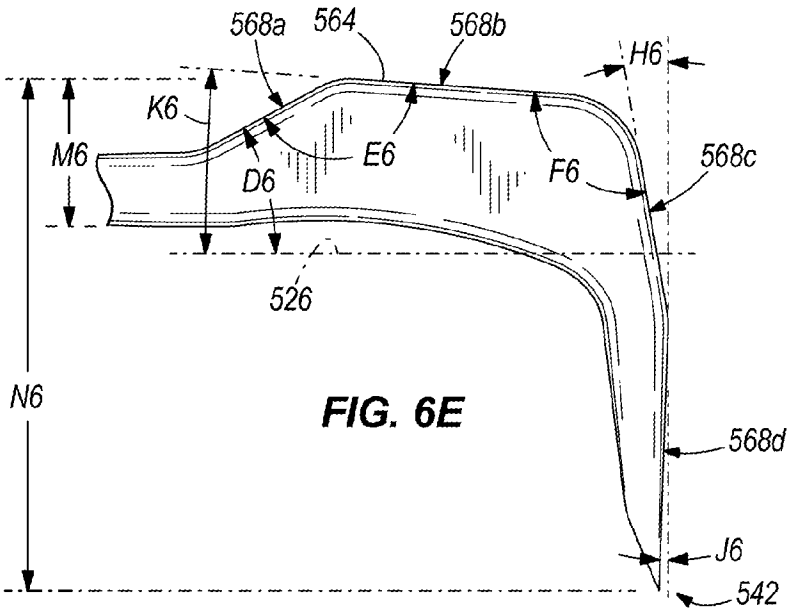
FIG. 6E is an enlarged view of a portion of the utility bar of FIG. 6D.
Figure 6F:
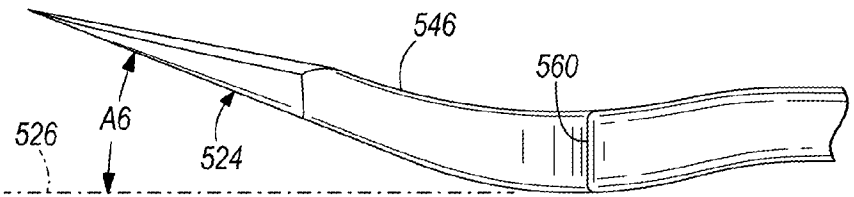
FIG. 6F is an enlarged view of a portion of the utility bar of FIG. 6D.

With particular reference to FIGS. 6D and 6F, a facet surface 524 of the pry bar portion 546 forms an angle A6 with the plane 526 of the shank 514. In the illustrated construction, the angle A6 is about 21.8 degrees. In other constructions, the angle A6 may be greater than or less than 21.8 degrees. In yet other constructions, the pry bar portion 546 may form one or more acute angles with the plane 526 having other values, shapes and configurations. For example, the pry bar portion 546 may have two or more facets and two or more pry bar fulcrum edges.

As best shown in FIGS. 6A-6C, a cutout or opening 560 is positioned along one side of the pry bar portion 546. The opening 560 defines a bottle opener point 566. During operation, the opening 560 receives a bottle cap, and the bottle opener point 566 engages the underside of the bottle cap attached to a bottle. The user applies a torque to the shaft 514 such that point 566 lifts up on the bottle cap. In other constructions, the opening 560 may be positioned partially in the pry bar portion 546 and partially in the shank 514. In still further constructions, the opening 560 may be positioned elsewhere on the bar 510, such as the shank 514, the head portion 564 or a combination of both.

The head portion 564 extends outwardly from the second end 522 of the shank 514 in a direction generally opposite the pry bar portion 546. In the illustrated construction, the head portion 564 is curved and includes a plurality of substantially planar facets. As shown, the head portion 564 includes four facets: a first facet 568*a*, a second facet 568*b*, a third facet

568*c* and a fourth facet 568*d*. An angle D6 is defined at an intersection of the first facet 568*a* and the plane 526. In the illustrated construction, the angle D6 is between about 24 degrees and about 32 degrees, and is preferably approximately 28.6 degrees. However, in some constructions the angle D6 may be greater than 32 degrees or less than 24 degrees.

The fourth facet 568*d* extends generally downward (i.e., away from the top surface 540) from the plane 526 on a side of the plane 526 opposite the first, second and third facets 568*a*, 568*b*, 568*c*. The second free end 542 of the fourth facet 68*d* has a width Y6, which is approximately 1.2 inches. In other constructions, the width Y6 may be less than or greater than 1.2 inches.

A first fulcrum edge or round 576*a* and an angle E6 are defined at an intersection of the first and second facets 568*a*, 568*b*. The angle E6 is between about 144 degrees and about 152 degrees, and is preferably approximately 147.7 degrees, as illustrated. However, in some constructions the angle E6 may be greater than 144 degrees or less than 152 degrees.

A second fulcrum edge or round 576*b* and an angle F6 are defined at an intersection of the second and third facets 568*b*, 568*c*. The angle F6 is between about 100 degrees and about 108 degrees, and is preferably approximately 104 degrees, as illustrated. However, in some constructions the angle F6 may be greater than 108 degrees or less than 100 degrees.

A third fulcrum edge or round 576*c* is defined at an intersection of the third and fourth facets 568*c*, 568*d*. The fourth facet 568*d* is substantially planar; however, the fourth facet 568*d*, as is shown in FIG. 6E, actually includes a very small angle J6. The angle J6 is approximately 2 degrees, but may be greater than or less than 2 degrees. In other embodiments, the fourth facet 568*d* may be truly planar. In yet other embodiments, the fourth facet 568*d* may be curved.

The third and fourth facets 568*c*, 568*d* define an angle H6 therebetween. The angle H6 is between about 6 and about 14 degrees, and is preferably approximately 10 degrees, as illustrated. However, in some constructions the angle H6 may be greater than 14 degrees or less than 6.

In the illustrated construction, the second facet 568*b* and the plane 526 of the shank 514 define an angle K6 therebetween. The angle K6, as illustrated, is about 4 degrees; however, in some constructions, the angle K6 may be greater than or less than 4 degrees. In yet other constructions, the second facet 568*b* may be generally parallel to the plane 526.

The head portion 564 includes the fulcrum edges, or rounds 576*a*-576*c* between the facets 568*a*-568*d*. In other constructions, the head portion 564 may include fewer or more facets and larger or smaller rounds between facets. In some constructions, the head portion 564 may have no rounds between facets, i.e., sharp edges. In some constructions, the head portion 564 may be substantially curved.

A hexagonal aperture 582 extends through the second facet 568*b*. The aperture 582 is sized and dimensioned to mate with a conventional hexagonal nut, such as the hexagonal nut on a circular saw, for removing the hexagonal nut.

The second facet 568*b*, at or near the first fulcrum edge 576*a*, as a height M6 with respect to the bottom 534 of the shank 514 of approximately 0.36 inches, and a height N6 with respect to the second free end 542 of approximately 1.22 inches. In other constructions, the height M6 may be between about 0.1 and 0.9 inches, and the height N6 may be between about 0.7 and 1.6 inches. In yet other constructions, the heights M6 and N6 may have other suitable values greater than or less than the ranges provided above. The free end 542 of the head portion 564, such as the fourth facet 568*d*, includes a second V-shaped notch 584 for removing fasteners, similar to the notch 550 at the free end 538 of the pry bar portion 546.

In operation, a user holds the shank 514 substantially normal to a support surface in which a fastener is embedded and slides the fourth facet 568*d* against the support surface and underneath the fastener. The second facet 568*b* may be struck to aid in wedging the free end 542, or fourth facet 568*d*, of the head portion 564 under the fastener to be removed. A pivoting or rocking force is then applied by a user to the shank 514 toward the support surface to remove the fastener. The pivoting force is applied in a direction such that the third fulcrum edge 576*c* serves as a pivot edge to provide leverage for removing the fastener. When the utility bar 510 pivots a predetermined amount, the second fulcrum edge 576*b* becomes the pivot edge to provide further leverage for removing the fastener.

The bottom surface of the pry bar portion 546 acts as a rocking pivot surface when the first V-shaped notch 550 is used. To use the first V-shaped notch 550, a user slides the beveled surface 554 under a fastener head embedded in a support surface and applies a force to the shank 514 toward or away from the support surface. The third and fourth facets 568*c*, 568*d* may be struck to aid in wedging the beveled surface 554 under the fastener head embedded in the support surface.

The thin edge 574 may be used to cut thin materials, the hexagonal aperture 582 may be used to loosen or remove hexagonal nuts, and the opening 560 and bottle opener point 566 may be used to remove bottle caps, as described above.

The features described in the constructions above may be combined in any manner to create various other constructions of a utility bar, which are hereby disclosed, but cannot be illustrated in every variation. Thus, the invention provides, among other things, a multi-use utility bar for removing fasteners such as staples and nails and for opening bottles.

The constructions described above and illustrated in the figures are presented by way of example only and are not intended as a limitation upon the concepts and principles of the present invention. As such, it will be appreciated by one having ordinary skill in the art that various changes are possible.

What is claimed is:

1. A utility bar comprising:

a shank portion for providing a grip, the shank portion including a first end and a second end;

a substantially arch-shaped head portion extending from the first end of the shank portion;

a pry bar portion extending from the second end of the shank portion, wherein each of the head portion and the pry bar portion define a free end of the utility bar;

a first facet including the free end of the head portion;

a second facet extending from the first facet at an angle with respect to the first facet and positioned between the free end of the head portion and the shank portion;

a first fulcrum edge between the first and second facets for providing a first pivot point about which the utility bar is pivoted to provide leverage;

a shank extension that extends from the first end of the shank along a plane defined by the shank and connects to an opposite end of the head portion, the shank extension including an aperture for removing a bottle cap from a bottle.

2. The utility bar of claim 1, further comprising a notch formed in the free end of the head portion.

3. The utility bar of claim 2, wherein the notch is a first notch, the pry bar portion further including:

a second notch at the free end of the pry bar portion for receiving a fastener; and at least two facets and at least one fulcrum edge for providing a second pivot point about which the utility bar is pivoted during removal of the fastener.

4. The utility bar of claim 1, wherein the angle is between about 9 and about 18 degrees.

5. The utility bar of claim 4, wherein the angle is about 13.3 degrees.

6. The utility bar of claim 1, wherein the utility bar is formed of titanium or titanium alloy.

7. A utility bar comprising:

a shank portion for providing a grip, the shank portion including a first end and a second end;

a substantially arch-shaped head portion extending from the first end of the shank portion;

a pry bar portion extending from the second end of the shank portion, wherein each of the head portion and the pry bar portion define a free end of the utility bar;

a first facet including the free end of the head portion;

a second facet extending from the first facet at an angle with respect to the first facet and positioned between the free end of the head portion and the shank portion;

a first fulcrum edge between the first and second facets for providing a first pivot point about which the utility bar is pivoted to provide leverage;

a third facet positioned between the second facet and the shank portion and extending from the second facet at a second angle with respect to the first facet; and a second fulcrum edge between the second and third facets for providing a second pivot point about which the utility bar is pivoted during the removal of the fastener.

8. The utility bar of claim 7, wherein the fastener is a first fastener, and wherein the head portion further includes an aperture for receiving a second fastener and removing the second fastener, and wherein at least one of the fulcrum edges is operable to provide the respective pivot point during removal of the second fastener.

9. The utility bar of claim 7, wherein the head portion further comprises a fourth facet positioned between the third facet and the shank portion and extending from the third facet at a third angle with respect to the third facet, and a fifth facet positioned between the fourth facet and the shank portion and extending from the fourth facet at a fourth angle with respect to the fourth facet, and wherein the fifth facet extends from the first end of the shank portion.

10. The utility bar of claim 6, wherein the first angle is between about 9 and about 18 degrees.

11. The utility bar of claim 10, wherein the first angle is about 13.3 degrees.

12. The utility bar of claim 10, wherein the second angle is between about 27 and about 35 degrees.

13. The utility bar of claim 12, wherein the first angle is about 13.3 degrees and the second angle is about 31 degrees.

14. The utility bar of claim 12, wherein the third angle is between about 121 and about 129 degrees.

15. The utility bar of claim 14, wherein the first angle is about 13.3 degrees, the second angle is about 31 degrees and the third angle is about 124.9 degrees.

16. The utility bar of claim 14, wherein the fourth angle is between about 48 and about 56 degrees.

17. The utility bar of claim 16, wherein the first angle is about 13.3 degrees, the second angle is about 31 degrees, the third angle is about 124.9 degrees and the fourth angle is about 52 degrees.

18. A utility bar comprising:

a shank portion including a grip and generally defining a plane through the shank portion that is generally parallel to a top or bottom surface of the shank portion;

a substantially arch-shaped head portion extending from a first end of the shank portion, the head portion having a first section extending from the shank portion and positioned on one side of the plane and a second section extending from the first section and positioned on an opposite side of the plane;

a pry bar portion extending from a second end of the shank portion; and an opening formed in the first section of the head portion, the opening configured for removing fasteners;

wherein the head portion further includes:

a first facet extending from the first end of the shank portion;

a second facet extending from the first facet;

a third facet extending from the second facet;

a first fulcrum edge at an intersection of the first and second facets; and a second fulcrum edge at an intersection of the second and third facets;

wherein the opening is included in the first and second facets, and wherein the second facet is positioned at an angle with respect to the plane.

19. The utility bar of claim 18, wherein the angle is about 2.7 degrees.

20. A utility bar comprising:

a shank portion including a grip and generally defining a plane through the shank portion that is generally parallel to a top or bottom surface of the shank portion;

a head portion extending from a first end of the shank portion, the head portion having a first substantially arch-shaped section extending from the shank portion and positioned on one side of the plane and a second section extending from the first substantially arch-shaped section and positioned on an opposite side of the plane;

a pry bar portion extending from a second end of the shank portion; and an opening formed in the first substantially arch-shaped section of the head portion, the opening configured for removing fasteners.

21. The utility bar of claim 20, further comprising a longitudinal axis generally defined by the shank portion, wherein the opening includes a first end and a second end, and the opening tapers from the first end to the second end in a direction parallel to the longitudinal axis.

22. The utility bar of claim 21, wherein the head portion includes a plurality of substantially planar facets, wherein the first end of the opening is located proximate an intersection of two of the facets and the second end tapers away from the shank portion.

23. The utility bar of claim 20, wherein the second section of the head portion defines a free end of the utility bar, and the free end includes a notch for receiving a fastener.

24. The utility bar of claim 20, wherein the second section of the head portion defines a free end of the utility bar, and the free end tapers to a thin edge.

25. The utility bar of claim 20, wherein the head portion includes a plurality of substantially planar facets, wherein the opening is positioned in at least one of the facets.

26. The utility bar of claim 20, wherein the head portion further includes:

a first facet extending from the first end of the shank portion at an angle between about 48 and about 56 degrees with respect to the plane; and a second facet extending from the first facet at an angle between about 121 and about 129 degrees with respect to the first facet;

wherein the opening is at least partially positioned in the second facet.

* * * * *